US010810827B2

(12) United States Patent
Grace et al.

(10) Patent No.: US 10,810,827 B2
(45) Date of Patent: Oct. 20, 2020

(54) GAMING SYSTEM HAVING SHIFTING ACCUMULATION OF BONUS WILDS

(71) Applicant: AGS LLC, Las Vegas, NV (US)

(72) Inventors: Jason Grace, Lilburn, GA (US); Nathan Daniel MacGregor, Atlanta, GA (US)

(73) Assignee: AGS LLC, Las Vegas, NV (US)

( * ) Notice: Subject to any disclaimer, the term of this patent is extended or adjusted under 35 U.S.C. 154(b) by 262 days.

(21) Appl. No.: 15/810,468

(22) Filed: Nov. 13, 2017

(65) Prior Publication Data

US 2019/0147691 A1 May 16, 2019

(51) Int. Cl.
*G07F 17/32* (2006.01)
*G07F 17/34* (2006.01)

(52) U.S. Cl.
CPC ..... *G07F 17/3213* (2013.01); *G07F 17/3209* (2013.01); *G07F 17/3225* (2013.01); *G07F 17/3244* (2013.01); *G07F 17/3267* (2013.01); *G07F 17/34* (2013.01)

(58) Field of Classification Search
CPC ..... G07F 17/3244; G07F 17/3258; G07F 17/3265; G07F 17/3267; G07F 17/34
See application file for complete search history.

(56) References Cited

U.S. PATENT DOCUMENTS 6,089,977 A * 7/2000 Bennett ..... G07F 17/34 273/143 R
6,251,013 B1 * 6/2001 Bennett ..... G07F 17/3211 273/143 R
6,290,600 B1 * 9/2001 Glasson ..... G07F 17/3265 273/143 R
6,517,432 B1 * 2/2003 Jaffe ..... G07F 17/32 463/16
7,396,279 B2 * 7/2008 Berman ..... G07F 17/3244 463/16
7,513,826 B2 * 4/2009 Cuddy ..... G07F 17/3244 463/20
8,197,329 B2 * 6/2012 Englman ..... G07F 17/32 273/143 R
9,235,965 B2 1/2016 Tuck
9,626,840 B2 4/2017 Williamson et al.
(Continued)

OTHER PUBLICATIONS

"Epic Monopoly", 2017 Scientific Games: https://www.sginteractive.com/games/game-library/game-detail/epic-monopoly.
(Continued)

*Primary Examiner* — Steven J Hylinski
(74) *Attorney, Agent, or Firm* — Vierra Magen Marcus LLP

(57) ABSTRACT

Wager-based video slot reel games are disclosed where prizes can be awarded based upon by-chance insertion of bonus wild symbols. In particular, a series of free spin games are provided. In each spin of the series of free spin games, a number of bonus wild symbols can be awarded by chance. The by-chance awarded wild symbols can be randomly distributed in a game outcome array. If and after the wild symbols are awarded, the number of next by-chance insertable wild symbols is increased and that increase is signaled to the player to thereby heighten the expectations of the player of winning even more bonus wild symbols by-chance in a next of the series of free spin games.

25 Claims, 17 Drawing Sheets

(56) References Cited

U.S. PATENT DOCUMENTS

| | | | | |
|---|---|---|---|---|
| 9,679,444 | B2 | 6/2017 | Ryan | |
| 2004/0033827 | A1* | 2/2004 | Gilmore | G07F 17/32 463/20 |
| 2004/0048646 | A1* | 3/2004 | Visocnik | G07F 17/32 463/16 |
| 2006/0058095 | A1* | 3/2006 | Berman | G07F 17/3244 463/16 |
| 2006/0068885 | A1* | 3/2006 | Cregan | G07F 17/3244 463/20 |
| 2006/0068893 | A1* | 3/2006 | Jaffe | G07F 17/3244 463/20 |
| 2008/0113742 | A1* | 5/2008 | Amos | G07F 17/32 463/20 |
| 2010/0197377 | A1* | 8/2010 | Aoki | G07F 17/32 463/20 |
| 2011/0136562 | A1* | 6/2011 | Loat | G07F 17/3265 463/20 |
| 2013/0231174 | A1* | 9/2013 | Fujisawa | G07F 17/326 463/20 |
| 2013/0324202 | A1 | 12/2013 | Ryan | |
| 2014/0323198 | A1* | 10/2014 | Tuck | G07F 17/34 463/20 |
| 2015/0065224 | A1* | 3/2015 | Aoki | G07F 17/34 463/20 |
| 2015/0141114 | A1 | 5/2015 | Davis et al. | |
| 2016/0104345 | A1 | 4/2016 | MacGregor et al. | |

OTHER PUBLICATIONS

"Dragon's Wild Slot From Everi Gaming", 2017 BestCasinosOnline.com: http://www.bestonlinecasinos.com/slots/software/everi/dragons-wild/.

* cited by examiner

GAMING SYSTEM HAVING SHIFTING ACCUMULATION OF BONUS WILDS

TECHNICAL FIELD

The present disclosure of invention relates to operations of a gaming machine within a gaming environment.

Slot-type electronic and/or mechanical gaming machines, often also referred as slot machines, are popular fixtures in casino or other gaming environments. Participants in gaming environments may include a primary player who is directly using the slot machine, an adjacent player who is directly using an adjacent slot machine, an adjacent bystander (e.g., a player's friend) who standing nearby the primary player or adjacent player and nearby passers by who happen to be passing by in an area where they can view part of the gaming action(s) of one or more of the slot machines. Slot machines use mechanical reels and/or video reels to present both action during development of a game outcome and an outcome of a slot game to a corresponding one or more players. Typically, before each gaming action by the machine (e.g., spinning of the reels or wheels), the player is required to ante up by placing at least one wager on the outcome of the gaming action. On the reels or wheels, wild symbols can appear. Wild symbols serve as a substitute for other symbols. In the prior art, wild symbols: (1) can occur by other symbols morphing into wild symbols; (2) be copied from one reel or wheel to another; (3) be dropped from a character onto the reels or wheels to change certain existing symbols; and (4) can populate a reel or wheel more frequently during free spins. On occasion however, a player is awarded with a series of so-called, free spins where the player does not put a wager amount at risk and yet the player may, in some respect, win something for nothing during anyone of the series of free spins. Due to such occasional sprinklings of chance of winning from free spins, wild symbols and/or due to various graphic and audio effects presented by the gaming action in general, the primary players and adjacent other persons may experience various emotional responses and derive entertainment value from the unique ways in which the game is played and presented on the gaming machine.

In one example of the prior art, a random Wild substitution game is featured in a base game and free spins, maximizing a number of ways to win by evaluating awards based on a number of symbols in any position (PowerX-Stream), and a scatter-initiated bonus with bonus symbols that appear on all reels during the base game. The display includes a top screen that features progressive windows and shows a statue holding a coin. During the bonus game, the statue flips a coin into the air and awards a random number of bonus Wilds, which end up covering symbol positions on the reels of a lower screen. These covered positions become the Wild symbols. However, the number (count) of Wilds to be rewarded (expected) is never displayed for the next spin. Accordingly, there is no indication to the player as to how many number of Wilds to expect during a next spin. Thus, it would be desirable to increase the potential for derived entertainment value and/or experienced emotional responses and heightened expectations through modifications to one or more slot machine designs and/or through modifications to an overall gaming environment of which the players and their onlookers are a part.

SUMMARY

Various embodiments in accordance with the present disclosure of invention generally relate to operating a gaming machine to generate one or more wager-based video slot games. Such wager-based video slot games can include ones where monetary or nonmonetary prizes, awards (e.g., additional free spins or free games) are awarded based upon the appearance of wild symbols within a spin outcome display where the locations of one or more of the displayed wild symbols allows for substitution of the wild symbols with appropriate other symbols that result in a winning combination of displayed symbols in a primary outcome display area (e.g., four Aces in a row, four Kings, other symbol combinations in a row or otherwise scattered). In particular, wild symbols can appear (or not) in a primary reels area during a series of bonus free spins. In accordance with an aspect of the present disclosure, an additional reel or wheel or other chance mechanism is provided outside the primary reels area (outside the primary game outcome array) and actuated (e.g., spun) during a developing free spin such that a super wilds symbol (e.g., WILD++) may come to be displayed within an active bonus providing region of the additional reel/wheel after a spin of that additional reel/wheel or other bonus providing chance mechanism. If that happens, a predetermined number of bonus wild symbols are deposited into (scattered rained into) the still developing primary reels area and the number of bonus wild symbols to be deposited the next time a super wilds symbol appears during a series of free spins is incremented (e.g., by one). The super wilds symbol (e.g., WILD++) is then converted into another symbol and the outcome of the spin in the primary game outcome area, based on the additionally deposited bonus wild symbols, is determined. Players may experience progressively greater excitement and expectation of a win as the number of bonus wild symbols to be deposited by chance a next time increases during a series of free spins.

More specifically, in accordance with one aspect of the present disclosure, a machine-implemented method is provided comprising the steps of: (a) receiving indication of a player submitted wager and responsively causing actuation of a first gaming action corresponding to the submitted wager; (b) after completion of the actuated first gaming action, causing initiation of a first series of free spin gaming actions; (c) during the first series of free spin gaming actions, causing presentation of a non-zero first count of bonus wilds that can be made available by chance for insertion into at least a first of the free spin gaming actions of the first series; and (d) during the first series of free spin gaming actions but after said causing of the presentation of the first count, causing presentation of a second count of bonus wilds that can be made available by chance for insertion into at least a second of the free spin gaming actions of the first series, the second count being greater than the first count and wherein said bonus wilds are non-sticking wilds which, when awarded, are only effective for the free spin for which they are awarded.

Additionally, in accordance with one aspect of the present disclosure, a machine system is provided comprising: (a) a first machine component receiving indication of a player submitted wager and to responsively cause actuation of a first gaming action corresponding to the submitted wager; (b) a second machine component, coupled to the first machine component to detect completion of the actuated first gaming action, after completion of the actuated first gaming action, causing by-chance initiation of a first series of free spin gaming actions; (c) a third machine component, coupled to the second machine component to detect initiation of the first series of free spin gaming actions and during the first series of free spin gaming actions, to cause presentation of a non-zero first count of bonus wilds that can be made available by-chance for insertion into at least a first of the free spin gaming actions of the first series; and (d) a fourth machine component, coupled to the third machine component to detect continuation of the first series of free spin gaming actions and during the continuation of the first series of free spin gaming actions but after said causing of the presentation of the first count, to cause presentation of a second count of bonus wilds that can be made available by-chance for insertion into at least a second of the free spin gaming actions of the first series, the second count being greater than the first count and wherein said bonus wilds are non-sticking wilds which, when awarded, are only effective for the free spin for which they are awarded. In one embodiment, the fourth machine component, during the continuation of the first series of free spin gaming actions but after said causing of the presentation of the second count, causing presentation of a third count of bonus wilds that can be made available by-chance for insertion into at least a third of the free spin gaming actions of the first series, the third count being greater than the second count. In one embodiment, the first gaming action includes an apparent spinning of chance reels or wheels whose chance settlement outcome can provide a winning combination of symbols along an active payline of the first gaming action; the first series of free spin gaming actions includes an apparent spinning of chance reels or wheels whose chance settlement outcome can provide a winning combination of symbols along an active payline of at least one of the free spin gaming actions; the first count of by-chance insertable wilds are operable to improve a chance of winning of the at least first of the free spin gaming actions if inserted along an active payline of said at least first of the free spin gaming actions; and the second count of by-chance insertable wilds are operable to improve a chance of winning of the at least second of the free spin gaming actions if inserted along an active payline of said at least second of the free spin gaming actions. In one embodiment, the machine system further comprises: (e) a fifth machine component, coupled to the third machine component to detect a non-completion of one of the first series of free spin gaming actions, and causing before completion of said one of the first series of free spin gaming actions, a presentation and subsequent actuation of a first chance mechanism having at least one chance outcome that results in insertion into the outcome of the said one of the first of the free spin gaming actions of said first count of by-chance insertable wilds; and (f) a sixth machine component, coupled to the fifth machine component to detect the at least one chance outcome that results in insertion and to responsively produce an outcome of the said one of the first series of free spin gaming actions that includes said insertion of the first count of by-chance insertable wilds. In one embodiment, the machine system further comprises: (e) a seventh machine component, coupled to the fifth machine component to detect the at least one chance outcome that results in insertion and to responsively cause presentation of graphics indicating to the player that the first count has been replaced by the larger second count.

BRIEF DESCRIPTION OF THE DRAWINGS

The present disclosure may be better understood by reference to the following detailed description taken in conjunction with the accompanying drawings, which illustrate particular embodiments of the present invention.

DETAILED DESCRIPTION

Reference will now be made in detail to some specific embodiments in accordance with the present disclosure of invention. While the present disclosure is described in conjunction with these specific embodiments, it will be understood that it is not intended to limit the teachings of the present disclosure to the described embodiments. On the contrary, it is intended to cover alternatives, modifications, and equivalents as may be included within the spirit and scope of the teachings of the present disclosure.

In the following description, numerous specific details are set forth in order to provide a thorough understanding of the present disclosure. Particular embodiments may be implemented without some or all of these specific details. In other instances, well known process operations have not been described in detail in order not to unnecessarily obscure the present disclosure of invention.

In general, gaming systems which provide wager-based games are described. In particular, with respect to FIGS. 1 and 2, gaming system including a wager-based gaming machines in communication with network devices are described. The gaming system can include wager-based games where a progressively growing prize or award is made possible.

Figure 1:
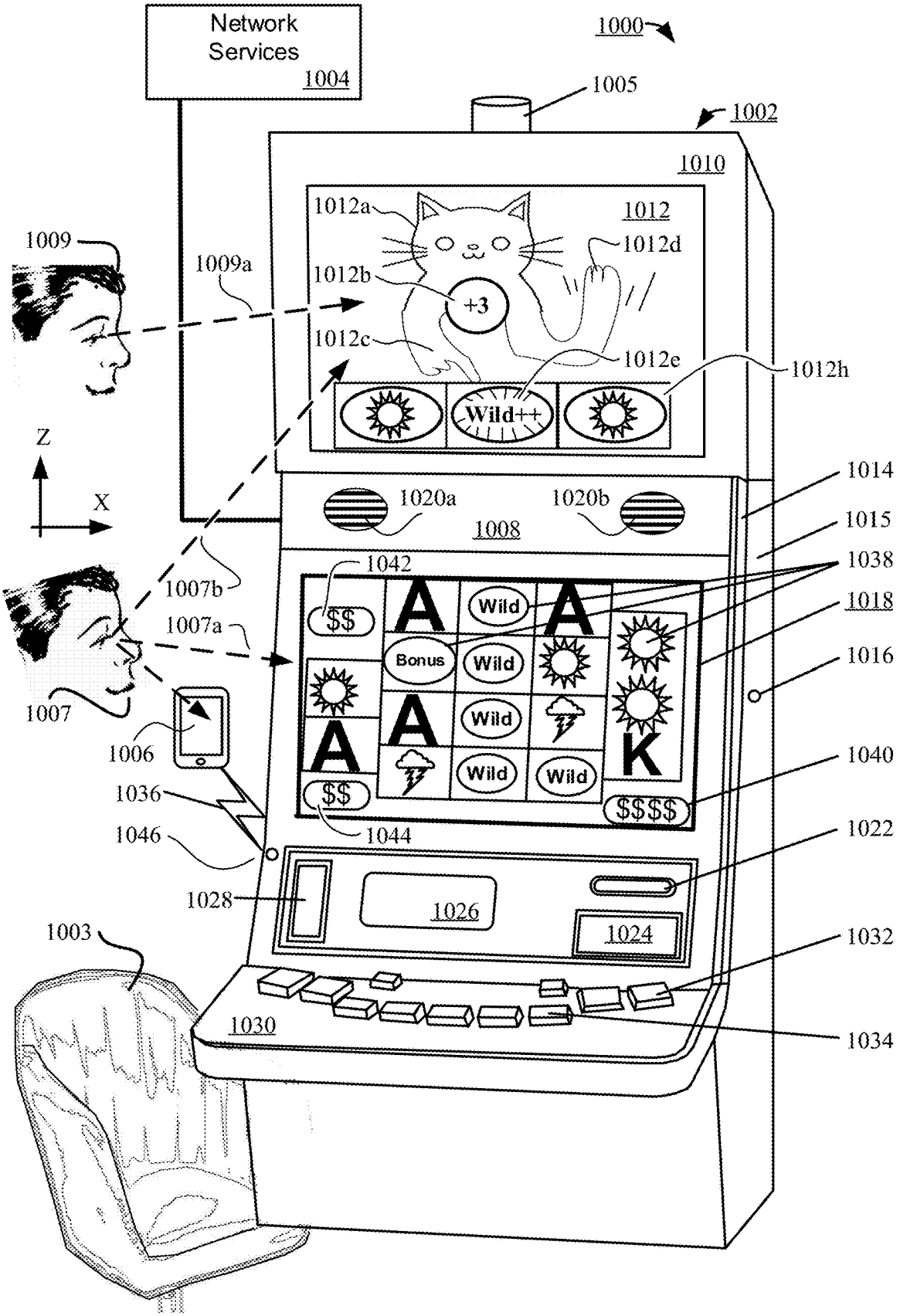
FIG. 1 illustrates a gaming system and environment including a wager-based gaming machine in accordance with the present disclosure.

FIG. 1 illustrates part of a gaming system 1000 in accordance with the disclosure that includes a wager-based gaming machine 1002. The wager-based gaming machine 1002 can include wireless or wired communication interfaces which allow communications with remote servers and/or other devices including a remote services providing network 1004 (e.g., having service providing servers and/or other data storing and processing units). The services providing network 1004 can provide privacy/integrity-secured services such as but not limited to player tracking and progressive gaming. (Some specific network services are described in more detail in conjunction with FIG. 2). The player tracking service can be part of a slot accounting system that for example keeps track of each players winnings and expenditures. In addition, the gaming machine 1002 can include wireless communication interfaces, such as a wireless interface 1046 (internal, not specifically shown) which allow communication with one or more mobile devices, such as a mobile phone 1006 (only one shown), a tablet computer, a laptop computer and so on via respective wireless connections such as 1036. The wireless interface 1046 can employ various electronic, optical or other electromagnetic wireless and secured or non-secured communication protocols, including for example Bluetooth™ or Wi-Fi.

The respective mobile phones (e.g., 1006) and/or tablet computers and/or other mobile devices can be owned and/or utilized by various players, potential customers or authorized casino operators. A mobile device carried by a primary player (e.g., 1007) can be configured to perform gaming related functions, such as functions associated with transferring funds to or from the specific gaming machine 1002 and the primary player's account(s) or functions related to player tracking. A mobile device carried by a casino operator can be configured to perform operator related functions, such as performing hand pays, responding to tilt conditions or collecting metering related information.

Use of mobile devices is not limited to secured transactions. In one embodiment, mobile devices may be used for social networking. For example, a primary player 1007 may authorize his/her mobile device (e.g., 1006) to automatically interact with a currently used gaming machine 1002 for the purpose of automatically posting to a user-chosen social network various announcements such as, but not limited to, that the primary player 1007 has been having fun playing the Friendly Feline Bonus Wilds game (a fictitious name for purposes herein) for X hours at the given gaming establishment or that Friendly Feline Bonus Wilds game has just awarded the primary player 1007 a number N of Bonus Wilds and may soon award that same player N+M additional Bonus Wilds (where here, X, M and N are numbers of appropriate values and in one embodiment, M is limited to a relatively small integer number such as in the range 1-3). The primary player 1007 may alternatively or additionally authorize his/her mobile device (e.g., 1006) to automatically announce (wirelessly) to a selected group of friends or associates that player 1007 has just been awarded a number N of Bonus Wilds at gaming machine 1002 and inviting them to stop by and watch the fun (e.g., as nearby other person 1009 is doing over the shoulder of the primary player 1007, where the latter in one embodiment, is seated in chair 1003 situated in front of gaming machine 1002.)

According to the same or an alternate embodiment, the primary player 1007 may use his/her mobile device (e.g., 1006) to temporarily reserve the particular gaming machine 1002 for a predetermined amount of time (e.g., no more than say 10 to 30 minutes) so that the primary player may temporarily step away to attend to various needs. While the primary player 1007 is temporarily away, the gaming machine 1002 may display a reservation notice saying for example, "This machine is reserved for the next MM minutes by a winning player who has progressed to a possibility of N+M additional Bonus Wilds on the next free spin. Stand by and watch the winnings!" (where here MM is a progressively decreasing time counter). The reservation notice may be prominently posted on an upper display 1012 of the gaming machine 1002 as shall next be described.

The gaming machine 1002 can include a base cabinet 1008 and an upper or top box 1010 fixedly mounted above the cabinet. The top box 1010 includes an upper display 1012. The upper display 1012 can be used to display video content, such as game art associated with the game being currently played on the gaming machine 1002. For example, the game art can include one or more animated wheels or reels (or other chance indicating mechanisms) and/or one or more animated creatures (e.g., the Bonus Wilds awarding Friendly Feline illustrated at 1012*a*). The animated wheels or reels (e.g., horizontally scrolling reel 1012*h*) can be configured to spin and to stop to reveal an occasional award of a bonus (e.g., triggered by appearance of a special symbol 1012*e*—WILD++ in this example—at a predetermined stoppage position or area) and the size of the award (e.g., indicated by bonus counter 1012*b* in this example). In one embodiment, the predetermined stoppage position or area may be pointed to by an animated finger 1012*c* of the Bonus Wilds awarding character 1012*a*—the exemplary Friendly Feline in the illustrated example. In one embodiment, a free other hand 1012*d* may wave or otherwise gesture to attract attention to the current appearance of the special symbol 1012*e* (WILD++ in this example) and/or to the size of the award (e.g., as indicated by bonus counter 1012*b* in this example). At other times and/or in other examples, the video content of the upper display 1012 can include advertisements and promotions. In accordance with an aspect of the present disclosure, the number of additionally awarded (by chance) wild symbols, as indicated by the bonus counter 1012*b*, progressively increases during a series of free spins. In one embodiment, the Bonus Wilds awarding Friendly Feline 1012*a* (or another animated character) draws attention to the fact that the number of additionally awarded (by chance) wild symbols is progressively increasing.

In alternate embodiments, the top box 1010 can include one or more mechanical devices in addition to the upper video display 1012. For example, mechanical devices, such as one or more mechanical wheels can be mounted to or within the top box 1010. The mechanical wheel(s) can include markings that indicate various bonus award situations and/or the sizes of the bonus awards. The wheel(s) can be spun and stopped at particular stopping points to reveal a bonus award situation (e.g., 1012*e*) and/or size of the bonus award (e.g., 1012*b*). In yet other embodiments, the top box 1010 can include a plurality of upper displays that provide similar functions. With respect to chance providing mechanisms as described herein, it is to be understood that such can include not only mechanical chance providing mechanisms (e.g., mechanical spinning wheel with relatively unpredictable stop position), but also electronically based chance providing mechanisms that can be implemented in the form of digital and/or analog electronic circuits. Such circuits may rely on flip-flops or registers designed with intentional meta-stability and/or on noise in tolerant switching circuits that are intentionally exposed to random noise (e.g., thermal noise) so as to provide relatively random and unpredictable outcomes.

It will be appreciated by those familiar with gaming environments that participants in various gaming environments (also briefly see FIG. 2) include respective primary players like 1007 who are directly using their respective slot machines (e.g., 1002) and are each typically seated on a chair (e.g., 1003) disposed in front of the gaming machine so as to thereby position that primary player's eyes substantially level with a central vertical position (along the vertical Z axis) with a primary game outcome display area 1018 of the gaming machine 1002 thus allowing for a comfortable gaze angle indicated by viewing vector 1007*a*. The primary game outcome display area 1018 typically being positioned vertically below and slightly spaced apart from the upper video display area 1012. The vertical elevation of the upper video display area 1012 is chosen so as to be easily viewed by adjacent player(s) who is/are directly using adjacent slot machines (for example at an eye incline angle shown as viewing vector 1007*b*) and also to be easily viewed by adjacent bystanders 1009 (e.g., a player's friends) who are standing nearby the primary player or nearby one of the adjacent players or are nearby passers by who happen to be passing by in an area where they can view part of the gaming action(s) of one or more of the slot machines; and in particular the actions displayed by the upper video display 1012 at a comfortable viewing vector 1009*a*. Due to real or simulated movements of the mechanical reels and/or video reels in the primary game outcome display area 1018 and in the upper video display area 1012, the primary players and the adjacent other persons may experience various emotional responses and derive entertainment value and expectations for further excitement from the unique ways in which the slot game (e.g., the Bonus Wilds awarding Friendly Feline game illustrated as an example in areas 1012 and 1018) is played and presented on the gaming machine. In accordance with one aspect of the present disclosure, an indicated size of next chance bonus award (e.g., as indicated by bonus counter 1012*b* in this example) progressively increases during a series of free spins. In one embodiment, the increase occurs after each successful bonus award (wild symbols being distributed into the primary game when a predetermined special symbol 1012*e* appears (WILD++ in this example) on an upper display reel, wheel or other such probability of appearance providing mechanism. In an alternate embodiment, the indicated size of next chance bonus award (e.g., as indicated by bonus counter 1012*b* in this example) progressively increases after each free spin during a series of free spins even if the additional wild symbols are not awarded. When the game concludes, the bonus count resets to 1 or another predetermined starting value (e.g., 0 or 2). If the primary player 1007 continues to win during a given series of free spins, the bonus count progressively increments to higher accumulated values and the expectation of chance for a bigger payout increases, thus providing increased entertainment and excitement to those nearby the gaming machine 1002 (and optionally to those on social media who are following the primary player's progress).

In terms of details for one embodiment, the base cabinet 1008 includes an internal access entry mechanism instantiated for example as door 1014. The door 1014 swings outward and is coupled to a back portion 1015. The door 1014 includes a locking mechanism 1016. During normal operation, the door 1014 is locked. Typically, unlocking the door 1016 causes the gaming machine 1002 to enter a tilt mode where gaming functions, such as the play of a wager-based game, are not available. This tilt mode can be referred to as a hard tilt.

The cabinet 1008 can include a number of apertures that allow access to portions of a number of devices which are mounted within the cabinet. These gaming devices can include, but are not limited to displays such as 1018 and 1026, speakers such as 1020*a* and 1020*b*, a printer 1022, a bill acceptor 1024, a magnetic and/or chipped card reader 1028 and a resting shelf and/or button panel 1030 including buttons 1032 and 1034. As described in more detail below, these gaming devices can be used to generate wager-based game play on the gaming machine 1002.

In particular embodiments, the bill acceptor 1024 can be used to accept currency or a printed ticket which can be used to deposit credits into an account maintained for the primary player 1007 and/or the gaming machine 1002. The credits can be used for wagers. The printer 1022 can be used to print tickets to transfer credits from one gaming machine (e.g., 1002) to another or to monetize accumulated credits. Typically, the tickets can be redeemed for cash or additional game play, such as game play on another gaming machine or at a gaming table.

Figure 2:
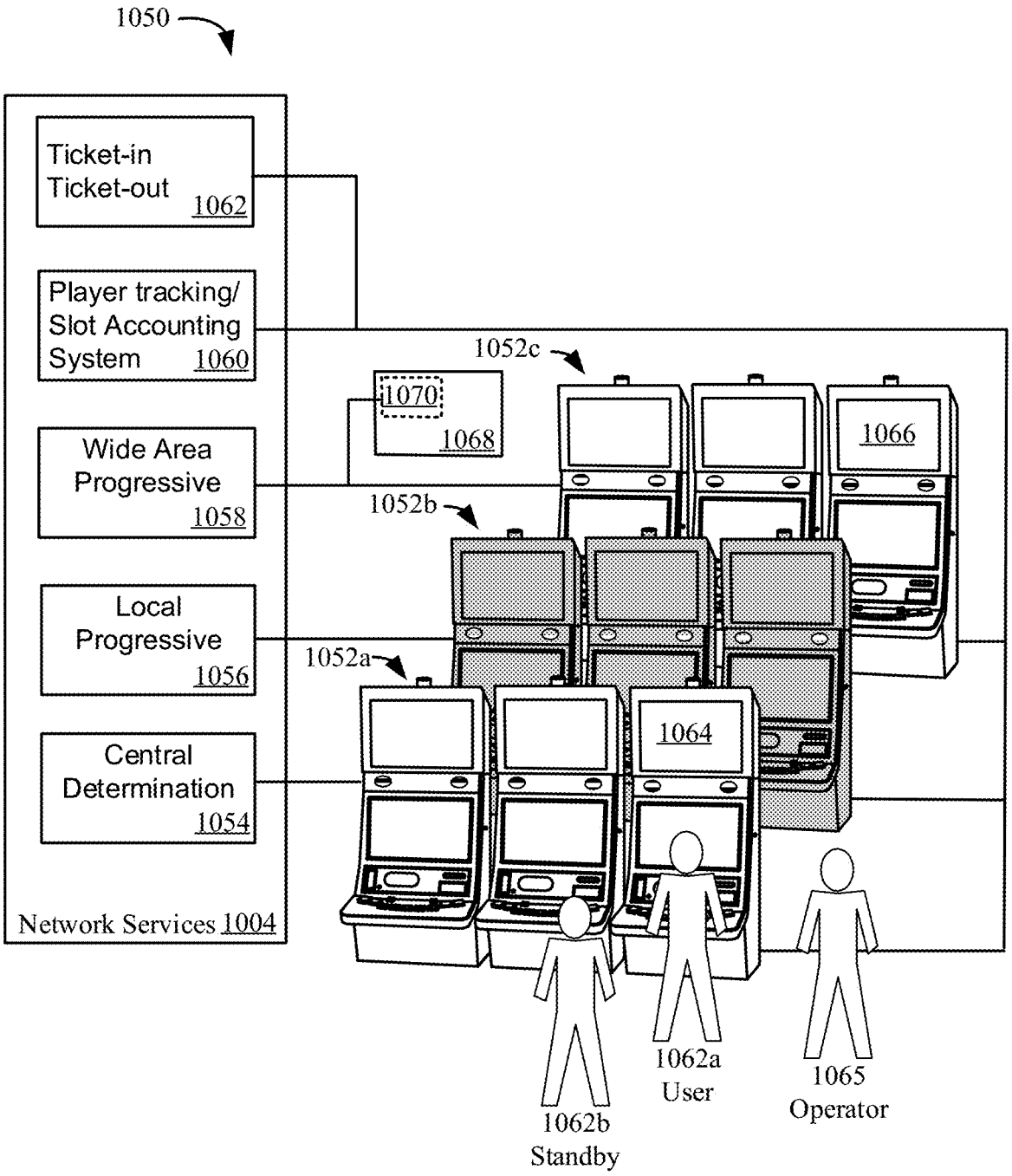
FIG. 2 illustrates a gaming system including three banks of gaming machines in accordance with the present disclosure.

The bill acceptor 1024 and printer 1022 printer can be part of ticket-in/ticket-out (TITO) system 1062 illustrated in FIG. 2. The TITO system 1062 can be included as one of the secured services provided by the services network 1004. The TITO system allows a ticket printed at a first gaming machine with a credit amount to be inserted into a bill acceptor at a second gaming machine and validated for game play. After validation, the credit amount associated with the ticket can be made available for game play on the second gaming machine. Additional details of the TITO system 1062 are described below in conjunction with FIG. 2.

The bill acceptor 1024 can include a slot surrounded by a bezel which allows banknotes of various denominations or printed tickets to be inserted into the bill acceptor. The bill acceptor 1024 can include sensors for reading information from the banknotes and determining whether the banknotes inserted through the slot are valid. Banknotes determined to be invalid, such as damaged or counterfeit notes, can be automatically ejected from the bill acceptor 1024. In some instances, the bill acceptor 1024 can include upgradeable firmware and a connection to additional network services. Via the network connection, new firmware, such as new counterfeit detection algorithms can be downloaded to the bill acceptor 1024.

The bill acceptor 1024 includes mechanisms for guiding the banknotes or printed tickets past the internal sensors. Banknotes or printed tickets which are accepted can be guided to a bill stacker (not shown) located within the cabinet 1008 of the gaming machine 1002. The bill stacker can hold a maximum number of bank notes or printed tickets, such as up to two thousand.

The gaming machine 1002 can include a sensor for detecting a fill level of the bill stacker. When the bill stacker is full or close to being full, the gaming machine 1002 can be placed in a tilt mode. Next, the cabinet door 1014 can be opened by authorized casino personnel and the full bill stacker can be replaced with an empty one. Then, the door 1014 can be closed and the gaming machine 1002 can be restored to a normal operational mode in which it is available for game play.

One function of the printer 1022 is to print "cash out" tickets. In a "cash out," credits available on the gaming machine can be transferred to an instrument, such as a printed and/or magnetically encoded ticket, or wirelessly transferred by way of a secure link to an appropriate account (e.g., the primary player's account) for later access. Typically, a "cash out" can be initiated in response to pressing one of the physical buttons, such as 1032 or 1034, or touch screen button output on a display, such as primary display 1018 or a secondary display such as the one 1026 illustrated to be smaller than and disposed below the primary game outcome display 1018.

In one embodiment, the printer 1022 can be a thermal printer. The printer can be loaded with a stack of tickets, such as a stack with two hundred, three hundred or four hundred tickets. Mechanisms in the printer can grab tickets from the ticket stack and transport the tickets past the print heads for printing. The ticket stack can be located in an interior of the gaming machine cabinet 1008.

The printer 1022 can include sensors for detecting paper jams and a status of the ticket stack. When a paper jam or low ticket stack is detected, the gaming machine 1002 can enter a tilt mode where game play is suspended. In one embodiment, a tower light 1005 disposed above the upper box 1010 can light to indicate the tilt status of the gaming machine 1002. After the tilt condition is cleared, such as by clearing the paper jam or replenishing the ticket stack, the gaming machine 1002 can enter a normal operational mode where game play is again available.

In particular embodiments, the printer 1022 can be coupled to a gaming machine controller (see 1160 in FIG. 2). The gaming machine controller 1160 can be configured to send commands to the printer which cause a "cash out," ticket to be generated. In addition, the printer 1022 can be coupled to other systems, such as a player tracking system (e.g., 1060 in FIG. 2). When coupled to the player tracking system, commands can be sent to the printer 1022 to output printed tickets redeemable for comps (comps refer to complimentary awards, such as but not limited to free credits, a free drink, a free meal or a free room) or printed coupons redeemable for discounts on goods and services.

As mentioned, in some embodiments, one or more wireless interfaces 1046 can be provided to operate as secured and/or unsecured wireless communication connections 1036. The wireless connections can be established for example between the gaming machine 1002 and one or more mobile devices, such as smart phone 1006. The wireless connection 1036 can be used to provide functions, such as but not limited to player tracking services, casino services (e.g., ordering drinks) and enhanced gaming features (e.g., displaying game play information on the mobile device). The wireless interface can be provided as a stand-alone unit or can be integrated into one of the devices, such as the bill/ticket acceptor 1022 and the card reader 1028. In addition, the bill/ticket acceptor 1022 and the card reader 1028 can each have separate wireless interfaces for interacting with the mobile device. In one embodiment, these wireless interfaces can be used with a wireless payment system, such as Apple Pay™ or Google Pay™. The wireless payment system can be used to transfer funds to the gaming machine that can be used for wager-based game play.

The door 1014 can allow secured entry access an interior of the cabinet 1008. Via this access, devices mounted within the cabinet, such as displays 1018, 1026; speakers 1020*a*, 1020*b*; bill/ticket acceptor 1022 or printer 1024 can be serviced and maintained. For example, a receptor configured to receive currency and tickets, coupled to the bill acceptor, can be emptied. The receptor is often referred to as a bill stacker. In another example, blank tickets can be added to the printer 1022 or paper jams can be cleared from the printer. When door 1014 is opened, the gaming machine can enter a hard tilt state where game play is disabled. Although not explicitly shown, the audiovisual input/output mechanisms of the gaming machine 1002 need not be limited to the illustrated displays 1018, 1026; speakers 1020*a*, 1020*b* and buttons 1032, 1034. Additional audiovisual input/output mechanisms may come in the form of touch-sensitive screens, haptic input/output devices such as vibrators, subwoofers, microphones for picking up verbal requests or audible indications of excitement by the primary player or adjacent other persons and so on. In one embodiment, the chair 1003 may be instrumented so as to detect not only when the primary player 1007 is seated on it, but also when that player is jumping up and down or otherwise moving in the chair due to heightened emotions. This detected movement can be fedback to the services network 1004 for adaptively learning what gaming combinations tend to provide more excitement and/or entertainment. With authorization by the primary player 1007, a microphone and/or motion detector on his/her mobile device 1006 may be activated to provide similar automated feedback.

In addition, a number of further devices (not shown) can be provided within the interior of the cabinet 1008. A portion of these devices is not visible through an aperture in the gaming machine cabinet 1008. For example, a gaming machine controller (GMC) which controls play of a wager-based game on the gaming machine can be found within the cabinet 1008. Typically, the gaming machine controller is secured within a separate lockable enclosure. Details of the gaming machine controller are described below with respect to element 1160 in FIG. 8.

As another example, a number of security sensors can be placed within the interior of the cabinet 1008. The security sensors (e.g., see 1140 in FIG. 8) can be configured to detect access to the interior of the gaming machine 1002. For example, the sensors can be configured to detect when the locking mechanism 1016 is actuated, the door 1016 is opened or a locking mechanism associated with the gaming machine controller enclosure is actuated. A power source, separate from an external power supply, such as a battery can be provided which allows the security sensors to operate and be monitored when the external power supply is not connected or stops functioning for other reasons.

In particular embodiments, the cabinet 1008 can have a sheet metal exterior designed to provide the rigidity needed to support top boxes, such as 1010 and light kits as well as to provide a serious deterrent to forced entry. For example, the sheet metal can be sixteen gauge steel sheet. Additionally, the door, such as 1014, can be backed with sheet steel in the areas around the displays. Other materials, such as wood, wood composites, can be incorporated into the cabinet and the example of sheet metal is provided for the purposes of illustration only.

Speakers, such as 1020*a* and 1020*b* (only two shown, but there can be more elsewhere disposed), can be protected by a metal screen. In one embodiment, a speaker, such as 1020*a* or 1020*b*, can include a subwoofer speaker portion. In general, a sound system associated with the gaming machine 1002 can include an audio amplifier and one or more speakers of various types, such as subwoofers, midrange speakers, tweeters and two-way speakers that also accept voice input.

If the main cabinet 1008 is entered, a "DOOR OPEN TILT" can be displayed halting game play and causing a "DOOR OPEN" event to be sent to the slot accounting system in 1004. In one embodiment, this message can be displayed on the main display 1018. These events can also be stored to the power hit tolerant memory. Upon door closure, the "DOOR OPEN TILT" will be replaced with a "DOOR CLOSED TILT" that can clear after the completion of the next game cycle. Additionally, a logic "DOOR OPEN TILT" can occur if the logic door is opened. The logic door is configured to be lockable independent of how the switch wiring is installed. The gaming machine 1002 can be configured to initiate the logic DOOR "OPEN TILT" regardless of whether or not a lock is installed on the logic door.

The displays such as 1018, 1012 and 1026, the speakers 1020, the printer 1022, the bill acceptor 1024, the card reader 1028 and the button panel 1030 can be used to generate a play of a wager-based game on the gaming machine 1008. Further, the primary display 1018 can include a touchscreen function. The touchscreen function can be used to provide inputs used to play the wager-based game. Some examples of wager-based games that can be played include but are not limited to slot games, card games, bingo games and lottery games. The wager-based games are typically games of chance and utilize a random number generator to determine an outcome to the game.

In general, the wager-based games can be classified as Class II and Class III games. Class II games can include bingo, pull tabs, lottery, punch board, tip jars, instant bingo and other bingo like games. Class III games can include but are not limited to slot games, black jack, craps, poker and roulette.

As described above, the wager-based game can be a slot game. The play of the slot game can involve receiving a wager amount and initiating a start of the wager-based game. A selection of a wager amount and a start of the wager-based game can be performed using buttons, such as 1032 and 1034, on button panel 1030. In addition, the button panel can be used to perform gaming functions, such as selecting a number of lines to play in a slot game, selecting the amount to wager per line, initiating a cash-out and calling an attendant. These functions will vary for different types of games.

In some embodiments, a touch screen function can be provided in or adjacent to (e.g., over) one or more of the displays, such as 1012, 1018 and/or 1026. The combination of the display and touch screen can be used to perform gaming functions that performed using the button panel 1030. Also, display and touch screen can be used to perform operator features, such as providing a game playback or a hand pay.

The play of wager-based game, such as a slot game, can involve making a wager and then generating and outputting a game presentation. The bet amount can be indicated in display area 1042. The game presentation can include a number of game features that vary from game to game. The game features provide variety in how the outcome to the wager-based is presented. For example, an award to the outcome of the game can be presented in a series of steps that vary from game to game. In some instances, a portion of the total award for a game can be awarded in each step. The steps and their graphical presentation can be referred to as game features. In various embodiments, information associated with one or more of the steps can be stored to a power hit tolerant memory. The power hit tolerant memory is discussed in more detail with respect to FIG. 2.

As an example, a portion of a slot game outcome presentation is shown on display 1018. The slot game outcome presentation can include displaying a plurality of normal reel symbols, such as pointed to by reference 1038 (e.g., blazing sun symbol, wild card symbol, bonus symbol etc.). During the game outcome presentation, the symbols can appear to move on the display 1018 (e.g., vertically to simulate a rotating reel). In addition, symbols can be made to appear to move off the display 1018 and new symbols can be made to newly appear onto the display 1018.

Different combinations of symbols can appear on the primary display 1018 for some period of time, which varies for each instance of the wager-based game that is played. At the end of an action-filled presentation, the symbols can be made to appear to settle and reach a final position or spin outcome. Then an award associated with the game outcome is presented on the display. The total award for the game can be indicated in display area 1044 for example and the total credits available on the gaming machine after the award can be indicated in display area 1040.

In particular embodiments, a portion of the award to the outcome of a game or spin can be presented as a bonus game or a bonus spin (e.g., a free spin). The portion of the award can be referred to a bonus award. The presentation of the bonus award can also be presented in steps where a portion of the bonus award is awarded in each step. These steps can be referred to as bonus game features. In some embodiments, information associated with the steps in the bonus game can be stored to the power hit tolerant memory. In various embodiments, components of the bonus game presentation can be presented on one or more of display 1018, 1012 and 1026.

More specifically in one embodiment, when a free spin takes place (e.g., indicated as such in one of display areas 1018, 1012 and 1026), a horizontal bonus reel **1012*h* is actuated and starts spinning. As the symbols in the primary display area 1018 start settling into a near-final outcome state, the horizontal bonus reel 1012*h* first settles into its final outcome state, where that latter state can include the presentation of a special bonus symbol 1012*e* (e.g., WILD++) in a predetermined region (or anywhere) on the displayed horizontal bonus reel 1012*h*. In that case the special bonus symbol 1012*e* visually converts into a predetermined number of extra WILD symbols that appear to drop down for scattered distribution into spots within the near-final outcome state of the primary display area 1018. The number of generated extra WILD symbols is established by a count kept in bonus counter 1012*b*. After that, if the game is not over, the count in bonus counter 1012*b* is incremented, for example by one. The converted special bonus symbol 1012*e* transforms into another symbol, for example a struck-through or slashed-over symbol indicating it is no longer an active special bonus symbol 1012*e* (e.g., WILD++). On a next free spin, the player 1007 may be awarded the incremented number of extra WILD symbols if the special bonus symbol 1012*e* (e.g., WILD++) re-appears in the predetermined region (or anywhere) on the displayed horizontal bonus reel 1012*h***.

It is to be understood that the description of how a number of extra WILD symbols are revealed for drop down into and for scattered distribution into spots within the near-final outcome state of the primary display area 1018 of FIG. 1 is merely illustrative as is the description of the displaying of number next to be awarded if the special bonus symbol **1012*e*** (e.g., WILD++) re-appears. A variety of other ways (with or without attendant sound effects) is possible and some more will be additionally be described below.

Next, referring to FIG. 2, further details of one embodiment of the network services providing portion 1004 and of gaming machine operations are described. In FIG. 2, gaming system 1050 includes three banks of gaming machines, **1052*a*, 1052*b* and 1052*c***. For purposes of illustration, three side-by-side gaming machines are shown in each bank although a different number could be used (e.g., 4, 5, 6 etc.).

The network services providing portion 1004 includes a central determination server 1054, a local progressive server 1056, a wide area progressive server 1058, a player tracking/slot accounting system server 1060 and ticket-in/ticket-out (TITO) server 1062. In gaming system 1050, all of the gaming machines in each bank, 1052*a*, 1052*b* and 1052*c*, are operatively coupled to the slot accounting system server 1060 and the TITO server 1062. However, only the gaming machines in bank 1052*a* are coupled to the central determination server 1054. Further, only gaming machines in bank 1052*b* and display 1068 are coupled to the local progressive server 1056. Finally, only the gaming machines in bank 1052*c* are coupled to the wide area progressive server 1058. The communication couplings between the gaming machines in each bank and the servers 1054, 1056, 1058, 1060 and 1062 can be wired connections, wireless connections or various combinations/permutations thereof.

In various embodiments, the central determination server 1054 can be used to generate a controlling portion of the game played on the gaming machines in bank 1052*a*. For example, the central determination server 1054 can be used to generate random numbers used to determine outcomes to the games played in bank 1052*a*. In another example, the central determination server 1054 can be used to generate all or a portion of the graphics used during play of the games on the gaming machines in bank 1052*a*. For instance, the central determination server 1054 can be configured to stream a graphical presentation of a game to a gaming machine, such as that of upper display graphics 1064 and/or of the gaming machine's lower displays. (Lower displays not numbered here because primary player 1062*a* is illustrated obstructing those further displays.) The streamed upper display graphics 1064 may include that which on occasion (e.g., randomly or pseudo-randomly) reveals an active special bonus symbol 1012*e* (e.g., WILD++), reveals the awarding of a number of extra WILD symbols and reveals a number (e.g., an incremented number) of further extra WILD symbols to be awarded should the active special bonus symbol 1012*e* re-appear. The streamed graphical presentations can be output to respective displays on respective ones of the gaming machines.

In one embodiment, the central determination server 1054 can be used to generate numbers used in a bingo type games played on the gaming machine in bank 1052*a*. These bingo type games are often referred to as class II games whereas traditional slot machines are referred to as class III games. In class II games, a draw of numbers is made. The numbers can be mapped to a bingo card, which the player purchases to play the bingo game. The draw of numbers can result in at least one winning game combination on the bingo cards participating in the current bingo game.

The central determination server 1054 can be configured to repeat the number draws for the bingo games at regular intervals. For example, number draws can be repeated every 20 milliseconds. Players at the various gaming machines coupled to the central determination server 1054, such as the players at the gaming machine in bank 1052*a*, can initiate bingo games which utilize the bingo numbers from a particular bingo number draw. The bingo numbers in the number draw can be mapped to a bingo card displayed on the screen of the gaming machine, such as 1064.

Wins can be indicated by a winning pattern on the bingo card, such as four in a row or four corners. In response to a winning pattern on a bingo card on a particular gaming machine, the central determination server 1054 can send a prize amount associated with the win to the gaming machine with the winning pattern. This prize amount can be displayed on the gaming machine and the credits associated with the prize amount can be deposited on the gaming machine. For example, win of a bingo game on gaming machine 1064 can result in a prize amount being displayed on the main display. Further, the prize amount can be deposited as credits on the gaming machine 1064 such that the credits are available for additional game play.

In one embodiment, the prize amount can be output to look like a slot game. For example, if the prize amount is ten credits. Video reels can be displayed spinning on a main display of the gaming machine and a reel combination associated with a ten credit win in a slot game can be output to the display screen. If the outcome to the bingo game on a particular gaming machine is no award, then the video reels can be displayed spinning and a reel combination associated with no award in the slot game can be displayed on the gaming machine. This process can be repeated on various participating gaming machines, as number draws for various bingo games are initiated and completed on the central determination server 1054.

The local progressive server 1056 can be used to generate one or more progressive prizes that are limited to a local group of gaming machines, such as only the gaming machines in bank 1052*b*. When games are played on the gaming machine in bank 1052*b*, an amount of each wager can be contributed to one or more progressive prizes. The local progressive server can receive the contribution amounts from the gaming machines linked to the progressive game and can keep track of the prize amounts associated with the one or more progressive prizes. The prize amounts for the one or more progressive prizes can be output to displays on the participating gaming machines as well as to separate displays near the participating gaming machines.

The local progressive server 1056 can be configured to receive information regarding gaming events on the participating gaming machines. For example, the local progressive server 1056 can be configured to receive a notification from each of the participating gaming machines when a game outcome has occurred associated with a win of a progressive prize. In other examples, the local progressive server can be configured to receive gaming information, such as when each game is played on one of the participating gaming machines, an amount of wagered for each game and when one or more type of game outcomes occur on each of the gaming machines.

The gaming information associated with gaming events on the one or more gaming machines can provide a basis for additional bonus scenarios. For example, a bonus award can be triggered on one of the gaming machines after a random number of games are played on the gaming machines as a group. As another example, a bonus award can be triggered on one of the gaming machines after a particular game outcome occurs a random number of times on the participating gaming machines as a group, such as a particular combination of symbols appearing a random number of times.

The wide area progressive server 1058 is connected to the gaming machines in bank 1052*c* and display 1066. The wide area progressive server 1058 can be used to enable a progressive game played on gaming machines distributed over a wide area, such as multiple casinos distributed within a state. Similar to the local progressive server 1058, when wagers are made, the wide area progressive server 1058 can receive contributions to the progressive prize from the participating gaming machines. The wide area progressive server 1058 can report these contributions to a remote device which tracks the total progressive jackpot. Further, if a progressive jackpot is won on one of the gaming machines to which it is connected, the wide area progressive server 1058 event can be reported to the remote device. Yet further, the wide area progressive server 1058 can receive a current progressive jackpot amount from the remote device. The current progressive jackpot amount can be reported on displays on the gaming machines participating in the progressive jackpot and/or nearby signage, such as 1068.

An exemplary display 1068 of yet another gaming machine or other display device (e.g., wide area display device) can have a digital sign controller 1070. The digital sign controller 1070 can have a network interface which allows it to communicate with a remote device, such as the wide area progressive server 1058. In this example, the digital sign controller 1070 can be configured to output information to display 1068 associated with the progressive game, such as a current jackpot amount.

In general, displays with digital sign controllers can be provided through out a gaming environment, such as casino. The digital sign controller, such as 1070, can be configured to communicate with a remote device. The remote device can be configured to send information to the digital sign controller to output to a display. The information can include video, audio and picture data. Further, the remote device can be configured to send commands to the display, such as a command to output information to the display. In one embodiment, the wide area display devices (e.g., 1068) may provide announcements of when particular gaming machines (e.g., 1002) in the local area have progressed beyond a predetermined threshold (e.g., 5) for the number (e.g., an incremented number) of further extra WILD symbols to be next awarded should the active special bonus symbol 1012*e* re-appear on that gaming machine.

The slot accounting system portion of server 1060 can receive accounting information from each of the gaming machine in system 1050, such as an amount wagered for each game and amounts awarded on each gaming machine and/or the number of further extra WILD symbols to be next awarded should the active special bonus symbol 1012*e* re-appear on that gaming machine. The server 1060 can also receive information which uniquely identifies each gaming machine including a machine ID number and a current game being played on the gaming machine. The accounting information can be used for auditing purposes.

The player tracking system portion of server 1060 can track the game play of individual users. For example, a player can input account information into one of the gaming machines that is associated with a player tracking account that has been previously set-up. Based on the account information, a particular player tracking account can be located. The player tracking account can include information which identifies an individual user, such as user 1062*a* (User 1062*a* can be playing games at one of the gaming machines in bank 1052*a*.). The player tracking account information can include a player's name, address, phone number, gender, etc. It is to be understood that the graphics presentations on any given gaming machine can be structured for entertainment and heightened emotions and/or expectations of not only the primary player 1062*a* but also for that of nearby other persons 1062*b*.

In one embodiment, a player, such as user 1062*a*, can insert a player tracking card in a card reader (e.g., see card reader 1022 in FIG. 1). The card reader can read player tracking account information from the player tracking card, such as on a magnetic strip on the card, and send the information to the player tracking/slot account system server 1060. Based upon the received player tracking account information, the player tracking system portion of server 1060 can locate a player tracking account.

The player tracking account information can be input via other means on the gaming machine. For example, as shown in FIG. 1, the gaming machine 1002 may be able to communicate with a mobile device, such as 1006. Thus, in one embodiment, the gaming machine 1002 may be configured to directly receive player tracking account information from a mobile device. In another embodiment, the gaming machine 1002 may be configured to generate an input interface on a touch screen display that allows a player to input player tracking account information.

After the player provides account information and an account is located, the player tracking system can enter accounting information associated with a player's game play into the identified player tracking account, such as an amount wagered over time. As described above with respect to FIG. 1, the accounting information associated with a player's game play can provide a basis for awarding comps to the player. For example, based upon a player's previous game play, the player tracking system portion of server 1060 can send an amount credits to the gaming machine on which the player is playing. In another example, the player tracking system portion of server 1060 can send a command to a printer (e.g., see 1022 in FIG. 1) on the gaming machine on which the player is playing to print out a ticket. The ticket can be redeemable for goods or services or a discount on goods or services, such as a free meal or discount a meal.

As described above, each of the gaming machines can be coupled to a ticket-in/ticket out (TITO) server 1062. TITO server 1062 can be used to generate and validate instruments associated with a credit and/or cash value. One example of an instrument, which can be generated and validated, is a printed ticket. Another example is a digital instrument, such as a printed ticket stored in a digital form. In one embodiment, a digital instrument can be stored on an electronic device carried by a user, such as a mobile device carried by user 1062*a*.

As an example, when a printer, such as 1022, is employed in a "cash out," the gaming machine controller (e.g., see 1160 in FIG. 8) can contact a TITO server (e.g., see 1062 in FIG. 2) with a cash out amount. In response, the TITO server can generate a unique number, associate the unique number with a value and send the gaming machine a unique number. The unique number can be sent to a printer (e.g., see printer 1022 in FIG. 1). Then, the printer can print a ticket with the unique number, such as a unique number encoded in a bar-code, and a value of the ticket, such as five dollars.

When the ticket is later presented for redemption, the unique number can be used to validate the ticket. For example, the user 1062*a* can "cash out" at a first gaming machine, such as 1064 in bank 1052*a*, and receive a printed ticket with a unique number generated by the TITO server 1062. Then, the user 1062*a* can go to a gaming second gaming machine, such as 1066 in bank 1052*c*, and insert the ticket into a bill acceptor (e.g., see 1024 in FIG. 1). The second gaming machine 1066 can contact the TITO server 1062 and send the ticket information, i.e., the unique number read from the ticket, to server 1062. Then, the server 1062 can validate the ticket and send back to the second gaming machine 1066 an amount of credits to deposit on the second gaming machine. The deposited credits can be used for additional game play.

In these examples, the servers can include processors, memory and communication interfaces. Various gaming functions are associated with each of the servers, 1054, 1056, 1058, 1060 and 1062. The described distribution of gaming functions is for the purposes of illustration in only. In alternate embodiments, combinations of gaming functions can be combined on the same server or repeated on different servers. For example, the central determination server 1054 can also be configured to provide a local progressive to the bank of gaming machine 1052*a*. In another example, the local progressive server 1056 can be configured to provide a number of different progressive prizes for different groups of gaming machines. In yet another example, the player tracking system portion of server 1060 can be configured to provide bonusing features at each of the gaming machines.

In FIG. 2, while gaming machines, such as those of displays 1064 or 1066, are operational, a user such as 1062*a* can engage in game play. Under some conditions, such as tilt conditions, game play can be suspended and an intervention by an operator, such as 1065, may be required. An operator intervention may require an operator, such as 1065, to be directly present at a gaming machine, such as that of display 1064. For example, the presence of an operator may be required to access an interior of the gaming machine to clear a tilt condition. In other examples, an operator may be able to clear a tilt condition from a remote location via a near field or other communication coupling with the gaming machine (e.g., using a mobile device such as 1006).

In one embodiment, during game play, the gaming machine can award an amount above some threshold amount. Prior to receiving the award, an operator, such as 1065, can be sent to the gaming machine to have the player fill out a form for tax purposes. In the United States, this tax form is referred to as a W2G form. In addition, the operator may verify that the gaming machine was operating properly when the award was made prior to the player receiving the award. For example, if the gaming machine indicates a progressive jackpot has been won, the operator may check to verify the gaming machine was operating properly. In a hand pay, the operator, such as 1065, may provide an instrument redeemable for the jackpot amount.

As described above and in more detail with respect to FIGS. 1, 8 and 9, an operator, such as 1065, may be required to be physically present at a gaming machine, such as 1064 and 1066, to clear a tilt condition. For example, to clear a tilt condition, the operator, such as 1065, may have to access an interior of a gaming machine to clear a paper jam in a printer or a bill acceptor (e.g., see printer 1022 and bill acceptor 1024 in FIG. 1). In another example, to clear a tilt condition, the operator 1065 may have to access an interior of the gaming machine, such as 1064, to add more tickets to a ticket printer or empty a note stacker associated with the bill acceptor. For some tilt conditions, the gaming machine operator 1065 may access a menu output on a main display of the gaming machine, such as 1064 or 1066, to perform a RAM clear. RAM clears are described in more detail below with respect to FIG. 8.

Figure 3:
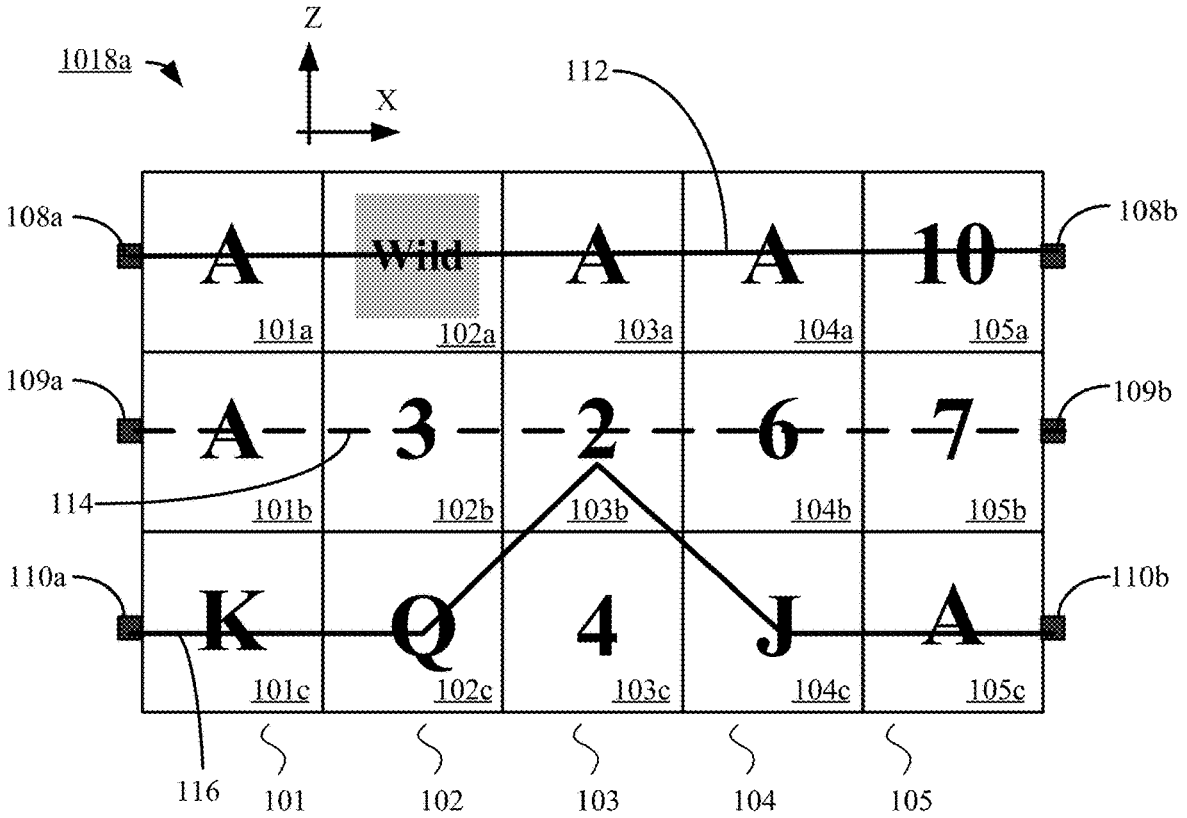
FIG. 3 illustrates a game outcome presentation with paylines in accordance with the present disclosure.

Referring to FIG. 3, shown is an example of a primary game outcome array 1018*a* having a 3×5 grid structure displaying three horizontal rows and five vertical columns. (Other grid configurations are possible, e.g., 4×5, 6×5, 6×6, etc.) Each of the five vertical columns represents the outcome of a respective one of vertically spinning reels 101, 102, 103, 104 and 105. Each reel 101-105 has a plurality of symbol displaying areas, typically populated by randomly selected normal game symbols. In the illustrated example, the symbols mostly correspond to those found in a game of playing cards (e.g., Jack, Queen, King, Ace, etc.). Other symbols may be used depending on the nature of the game. The reel populating symbols may further include a so-called Wild symbol as illustrated for example displayed area 102*a* of the second vertical reel 102. When such a Wild symbol shows up, it may be used to substitute in for another symbol needed for a winning hand along a corresponding payline. Therefore, for horizontal payline 112 which extends as a straight line between respective start and end points 108*a* and 108*b*, the Wild symbol at position 102*a* may substitute in for an Ace symbol ("A") thereby creating a card hand with four Aces in it. In one embodiment, players can determine which and what kinds of paylines will be active during each wagered upon game or spin. For example, a player may have only wagered on the outcome of the central horizontal payline 114 without allowance for scatter, where in the illustrated example that payline 114 displays the spin outcome of "A, 3, 2, 6, 7". In another example the player may have alternatively or additionally wagered on the outcome of a scatter-capable, lower pay line 116 where the scatter capability allows for one deviation into an adjacent outcome row for acquiring a symbol needed for winning the hand. Therefore, in the illustrated example where the player needs a "2" symbol such as is present in cell 103*b* to complete a five card straight consisting of the sequence, "Jack Queen King Ace, 2", the deviation capable pay line skips by the useless "4" symbol in cell 103*c* and instead deviates up into cell 103*b* to complete a potentially winning hand (depending on what specific game is being played and what wagers have been placed).

Figure 4:
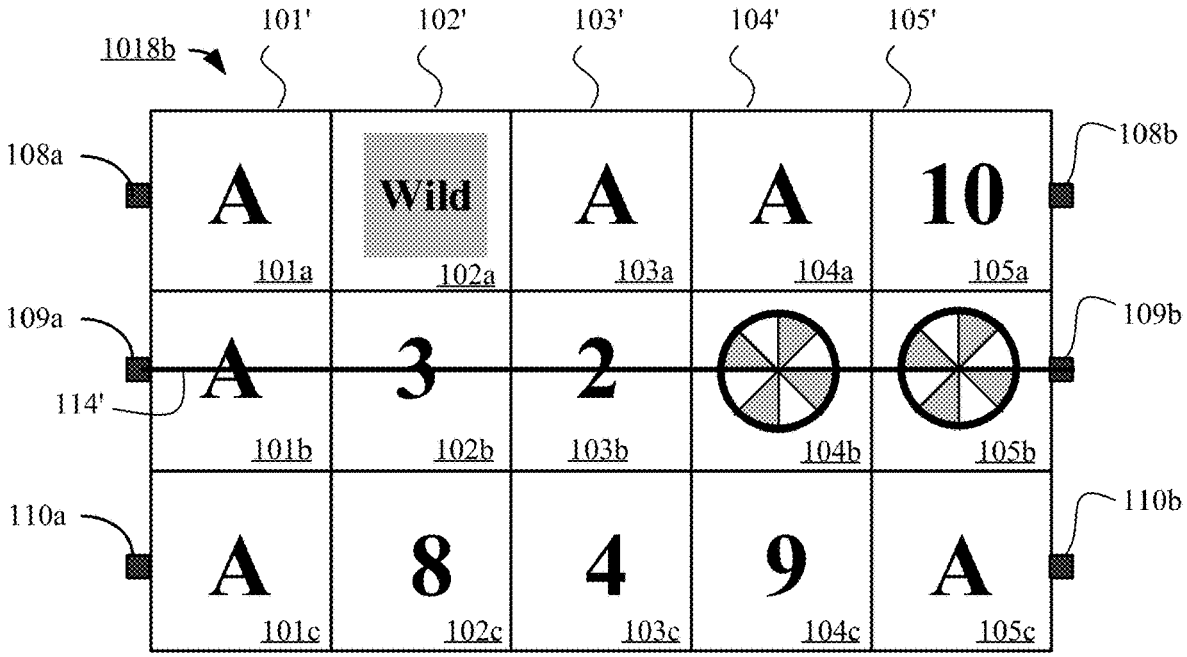
FIG. 4 illustrates a game outcome presentation indicating a trigger of free spin bonus in accordance with the present disclosure.

Referring to FIG. 4, shown is an example of a further state of a 3×5 primary game outcome array 1018*b*. In this particular example, the player had decided prior to the first spin of all five reels 101'-105' to not wager on the off-center paylines that otherwise would have respectively formed between start/end points 108*a*/108*b* and 110*a*/110*b*. Thus, the one Wild symbol that happened to appear in cell 102*a* does not help the player. However, for the given example, because the player has played a number of games beyond a predetermined threshold, the system has decided by chance to give the player one or more free spins. In the illustrated example, the start of a free spins state is indicated by the replacement in cells 104*b* and 105*b* of the "6, 7" symbols of FIG. 3 with two chance replacement wheels. If the player is lucky, the system awarded free spins (in just cells 104*b* and 105*b* in this non-limiting example) will replace the previous outcome (e.g., the "6, 7" symbols of FIG. 3) with alternate randomly drawn replacement symbols in cells 104*b* and 105*b* that provide a better hand along the central payline 114'. One of the chance awarded replacement symbols could be a Wild symbol. Alternatively, the free spins of the chance wheels in cells 104*b* and 105*b* will provide a "4" or even a combination of "4, 5" or of "4, K" or a "4, Wild" or of "K, Wild" thus providing an improved outcome along the central payline 114'.

Figure 5A:
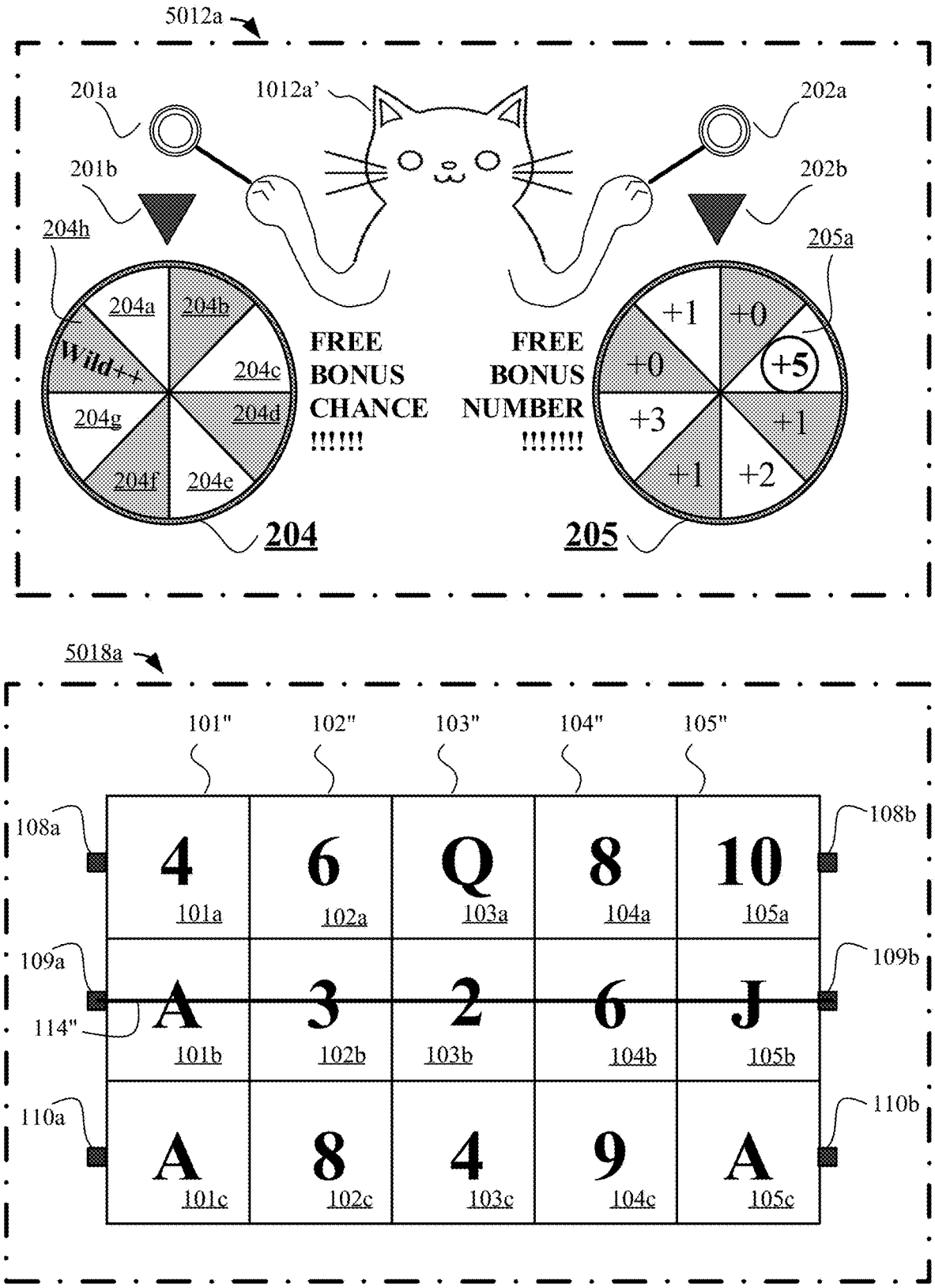
FIGS. 5A, 5B, 5C and 5D illustrate various states of free spin bonus games that include a chance for distribution of additional wild symbols and a chance at a progressively growing number of such chance distributed additional wild symbols in accordance with the present disclosure.

Referring to FIG. 5A, shown is a state in accordance with one embodiment where a corresponding gaming machine is settling into a determined initial outcome (in primary outcome array 5018*a*) for a so-called "free spin" (generally as one of a series of free spins, e.g., 5, 10 or more in succession). In the illustrated example, only the central payline 114" is active. As seen, it is settling towards a payline outcome having the symbols, "A, 3, 2, 6 and J". However, for this particular embodiment, the gaming machine (or the graphics sourcing server in the network services 1004) has determined that, because this is the settling state is for the so-called "free spin" (among a series of free spins), a chance for bonus Wild symbols is in order. Therefore, in automated response to automated determining that the "free spin" is settling, the machine system is programmed to provide notification in the upper display area 5012*a* that a free bonus chance is being initiated. A variety of different ways may be implemented for providing such an announcement, including for example the use of bells or other attracting sounds or graphic effects. In the illustrated example, the Bonus Awarding Friendly Feline 1012*a*' morphs into a state where it is seen holding two strikers, 201*a* and 202*a*. The left side striker 201*a* is positioned above spinning wheel activator 201*b*. The right side striker 202*a* is positioned above spinning wheel activator 202*b*. First, the Bonus Awarding Friendly Feline 1012*a*' strikes the left side striker 201*a* against the left side spinning wheel activator 201*b*. A gong or other such sound may be used to indicate that the first striking has occurred. In response, a left side bonus chance wheel 204 begins spinning. Prior to the spin and/or at a slow start up of the spin, the left side bonus chance wheel 204 allows the primary player (and others nearby) to see that at least one option on the left side bonus chance wheel 204 contains a special symbol (e.g., Wild++) representing an opportunity for bonus wild cards (or other forms of bonus wild symbols depending on the game). In the illustrated example, the special symbol (e.g., Wild++) is disposed at least in wheel slice 204*h*. Others of the wheel slice positions 204*a*-204*g* may also be filled with symbols or may be blank. The other symbols of wheel slice positions 204*a*-204*g* typically will not include an additional special symbol (e.g., Wild++) although in an alternate embodiment there may be more than one such special symbol (e.g., Wild++) distributed among wheel slice positions 204*a*-204*g*. It is to be understood that although the illustrated random spinning wheel 204 is illustrated as having eight wheel slice positions, it is within the contemplation of the present disclosure to have different numbers including more or less than eight and not necessarily all of equal slice sizes (where equal slice sizes indicate equal chances and larger slice sizes indicate increased chance of landing on those slices).

Either after the left side bonus chance wheel 204 finishes spinning or even before (for example when the system knows that the left wheel 204 will land on the special symbol (e.g., Wild++)), the Bonus Awarding Friendly Feline 1012*a*' strikes the right side striker 202*a* against the right side spinning wheel activator 202*b*. A gong or other such sound may be used to indicate that the second striking has occurred. In response, a right side bonus chance wheel 205 begins spinning. Prior to the spin and/or at a slow start up of the right side spin, the right side bonus chance wheel 205 allows the primary player (and others nearby) to see that at least one option on the right side bonus chance wheel 205 contains a currently maximum number of bonus wild symbols to be awarded. In the illustrated example that current maximum number is disposed in wheel slice 205*a* and has a value of +5. Other award options may appear in other of the wheel slices of the right side bonus chance wheel 205. In the illustrated example, the other award options are integer values less than the current maximum number in the wheel slice 205*a* and one or more of those other award options may be a disappointing zero (0) value. In accordance with an alternate embodiment, the current maximum award number (e.g., +5) may appear in more than just one of the wheel slices of the right side bonus chance wheel 205. Additionally or alternatively, some of the wheel slices of the right side bonus chance wheel 205 may be blank or filled with other symbols aside from numerical ones representing bonus amounts.

Figure 5B:
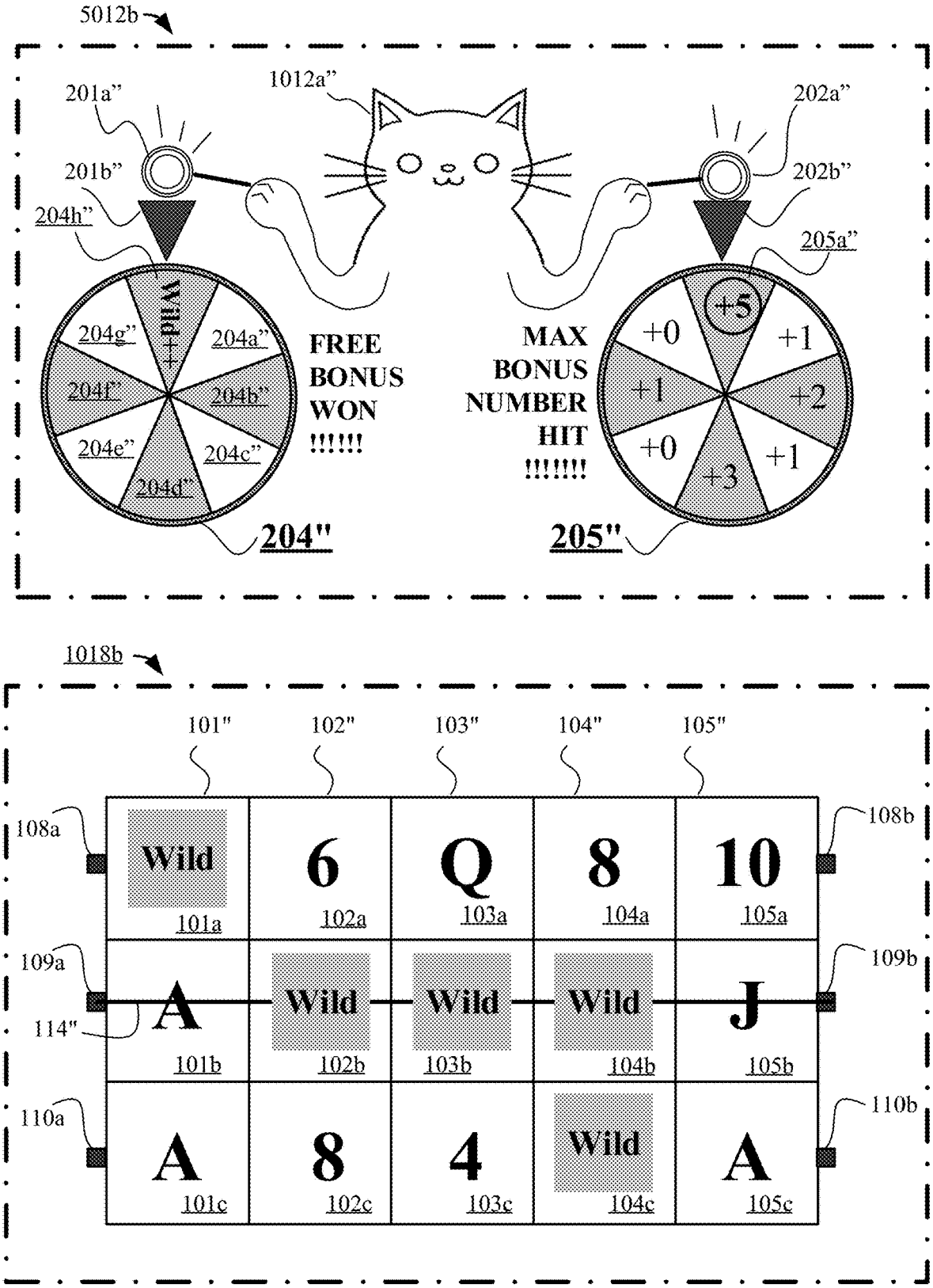

Referring to FIG. 5B, shown is a subsequent state in which the chance wheels of the upper display (now referenced as 5012*b*) have stopped spinning and have produced respective outcomes. The left side bonus chance wheel (now referenced as 204") has stopped with the slice 204*h*" containing the special symbol (e.g., Wild++) disposed adjacent to award indicating arrow 201*b*". The right side bonus chance wheel (now referenced as 205") has stopped with the slice 205*a*" containing the current maximum award number (e.g., +5) disposed adjacent to award indicating arrow 202*b*". Attractive lights or other notice getting graphics may emanate around the regions of strikers 201*a*" and 202*a*" to indicate that the bonus spin action is complete and optionally to indicate that a maximum bonus amount has been awarded. In one embodiment, a number of Wild symbols equal to the number indicated under the right side award indicating arrow 202*b*" then stream in from either the top left or top right corner of the upper display 5012*b* and snake or otherwise parade their way for example with right to left and then left to right motions as a meandering train advancing down to the bottom of the upper display for 5012*b*. Then they exit the upper display for 5012*b* and reappear as entering from the top left or right corner of primary outcome display 1018*b* for random scatter drop off among the cells of the primary outcome display 1018*b*.

As seen by the settled state outcome of FIG. 5B, the awarded five bonus Wild symbols have by chance, scattered deposited into respective cells 101*a*, 102*b*, 103*b*, 104*b* and 104*c* among the settled vertical outcome reels 101"-105". Accordingly, the final spin outcome along the central payline 114" has the symbol combination: Ace, Wild, Wild, Wild, Jack which can substitute as next shown in FIG. 5C to be an improved symbol combination of Ace, 10, Queen, King, Jack (or another such substituted and better combination).

Figure 5C:
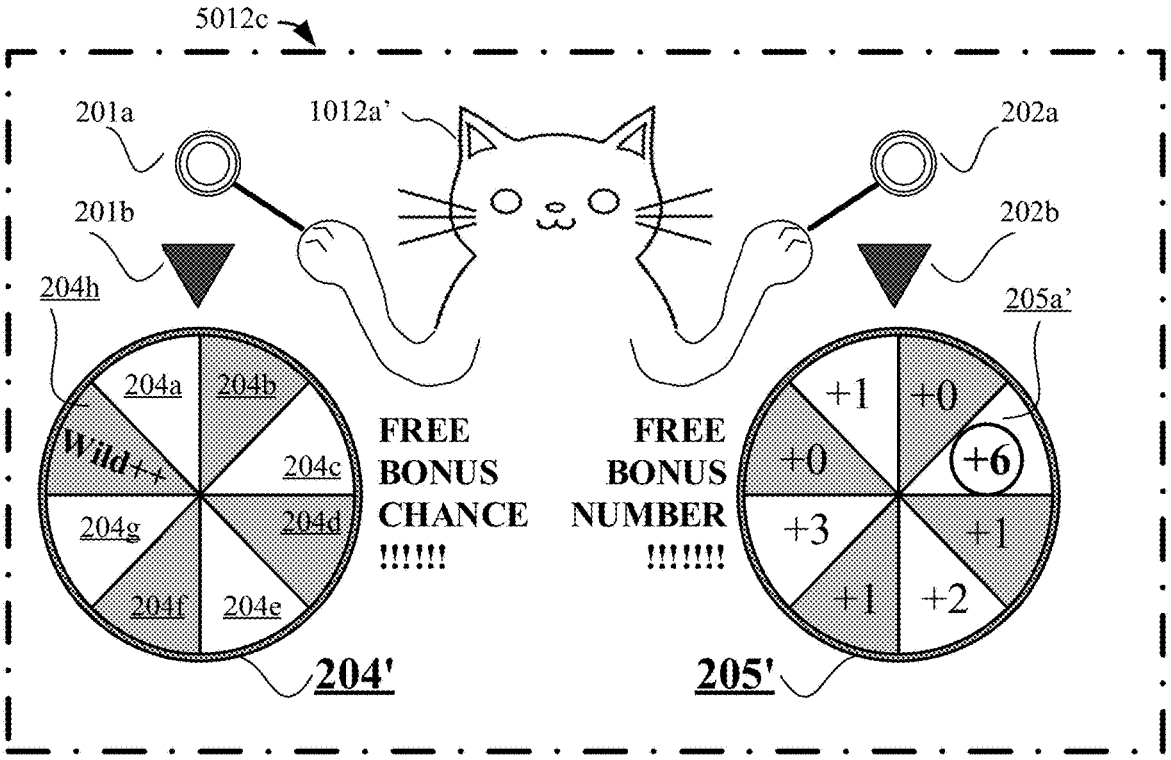
Figure 5C:
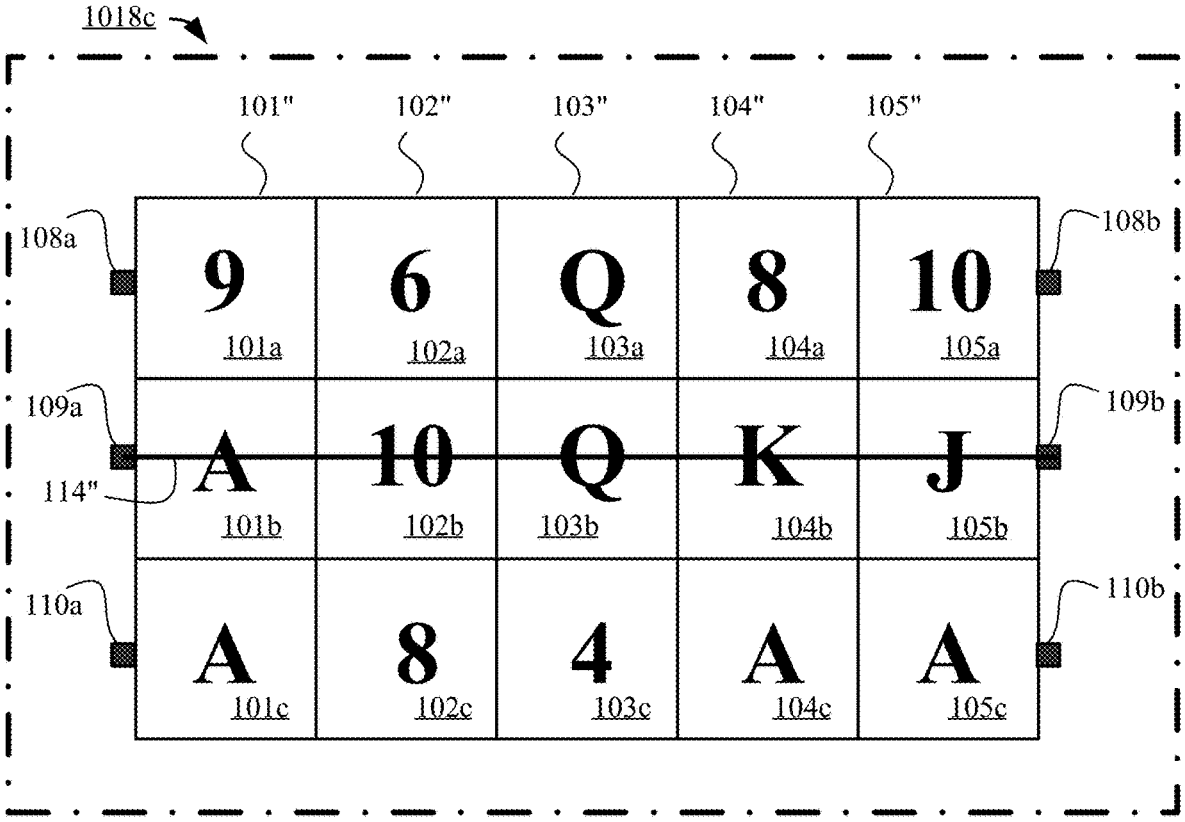

FIG. 5C illustrate the outcome of the bonus award action. Of importance, in the upper display (now referenced as 5012*c*) the current maximum award value has been incremented, for example from +5 (as shown in FIG. 5B) to +6 as now shown in slice 205*a*' of FIG. 5C. The left side and right side bonus awarding wheels, 204' and 205' have now returned to their uncommitted states and are ready for further action if a further free spin state is encountered. On that next free spin state the maximum award value will be the incremented value, in the illustrated case +6 as indicated in wheel slice 205*a*'. It is within the contemplation of the present disclosure that the incremented amount can be greater than one and may be fixed or variable. Additionally, although the other bonus amount numbers in the right side bonus awarding wheel 205' are the same as they were in FIG. 5A, it is within the contemplation of the present disclosure that one or more of these less than maximum bonus amount values may be incremented as well at the end of a bonus awarding spin.

Figure 5D:
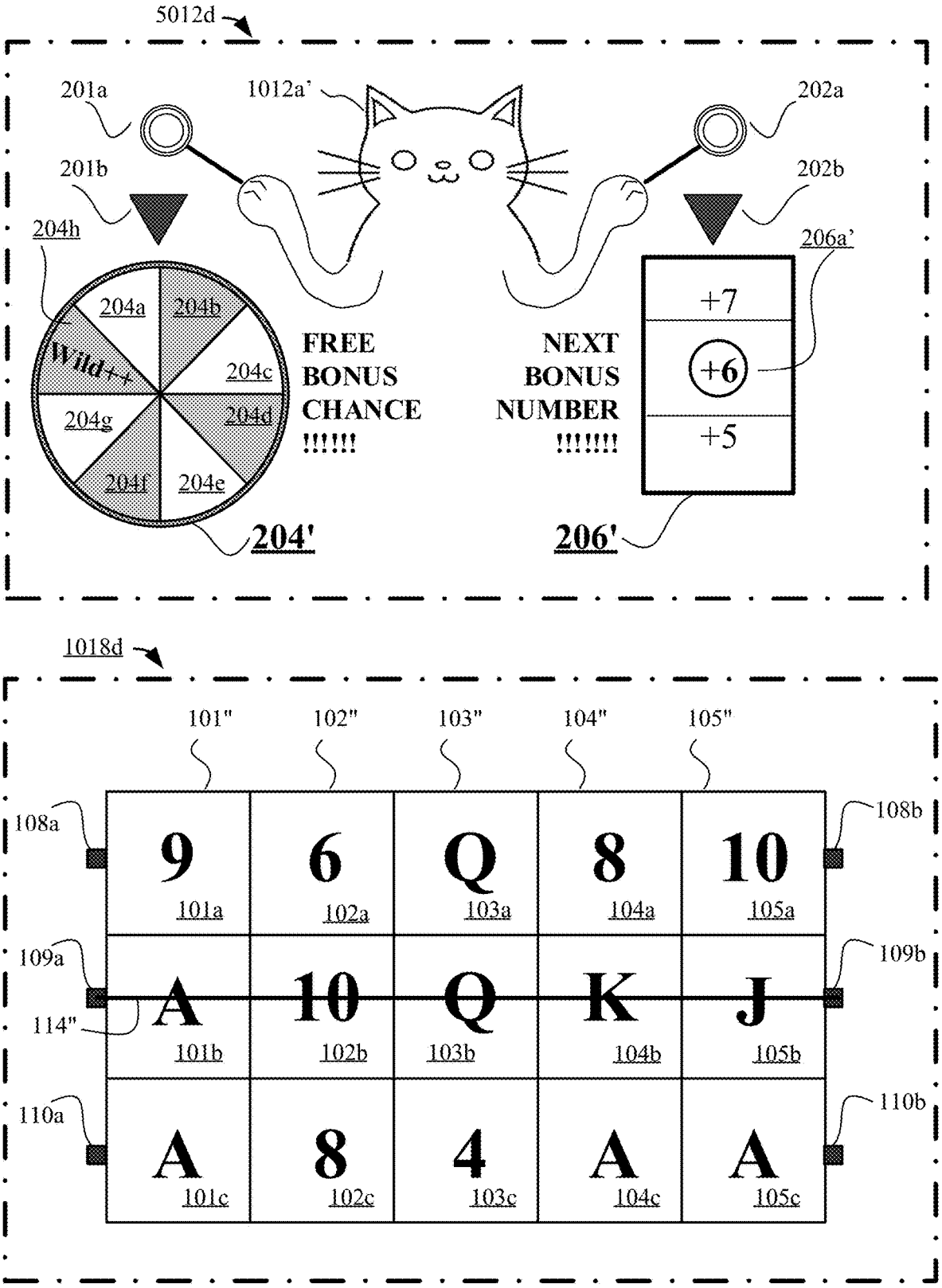

Referring to FIG. 5D, shown is an alternate embodiment in which rather than having a bonus amount spin the wheel 205, the upper display 5012*d* has an incrementing counter 206' which increments at the end of each bonus awarding spin. In one embodiment, the Bonus Awarding Friendly Feline 1012*a*' performs some noticeable ceremony each time the fixed (e.g., 206*a*') or spin determined (e.g., 205*a*') maximum bonus amount is incremented. For example, the Bonus Awarding Friendly Feline 1012*a*' may move the right side striker 202*a* to strike against the area in which the fixed or spin determined maximum bonus amount is displayed as that number is incremented. An appropriate gong or other sound as well as notice attracting graphics may be output at the time of the incrementing. Thus, the primary player and/or others nearby may take notice that a higher amount will or is likely to be awarded the next time the bonus awarding action takes place. This can increase the export excitement and expectations of the primary player and/or others nearby.

Figure 6A:
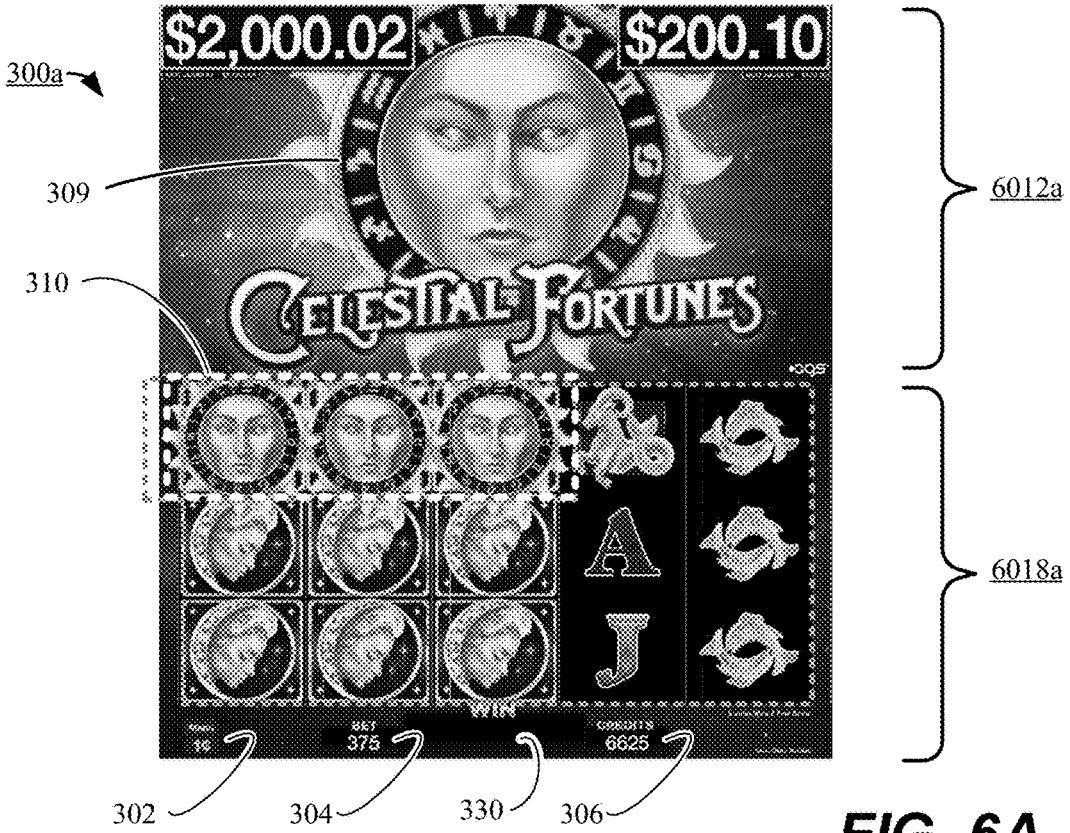
FIGS. 6A to 6D illustrate a primary game and a free spin bonus game, including wild symbols accumulation and distribution, in accordance with the present disclosure.

Referring to FIG. 6A, shown is another 3×5 grid structured gaming action in accordance with the present disclosure. The blazing sun symbol 309 as seen in upper display portion 6012*a* of a first state 300*a* of the illustrated "Celestial Fortunes" game is intended to represent good luck. As illustrated in the lower display portion 6012*b*, in area 304; the player has wagered an amount corresponding to 375 credits. Area 302 provides a menu display area which indicates for example, the value of a minimum wager. Area 306 shows a number of credits the player currently has on account for the current gaming machine. The 3×5 grid structured game outcome area in the lower display portion 6012*b* shows that the player has not won any monetary gains as a result of the spin produced set of symbols. Accordingly, the win amount area 330 at the bottom of the display is blank. However, as indicated in dashed rectangular area 310, a horizontal triplet of the blazing sun symbols has appeared, meaning that the machine system has by chance determined that this player should be awarded a plurality of free spins.

Figure 6B:
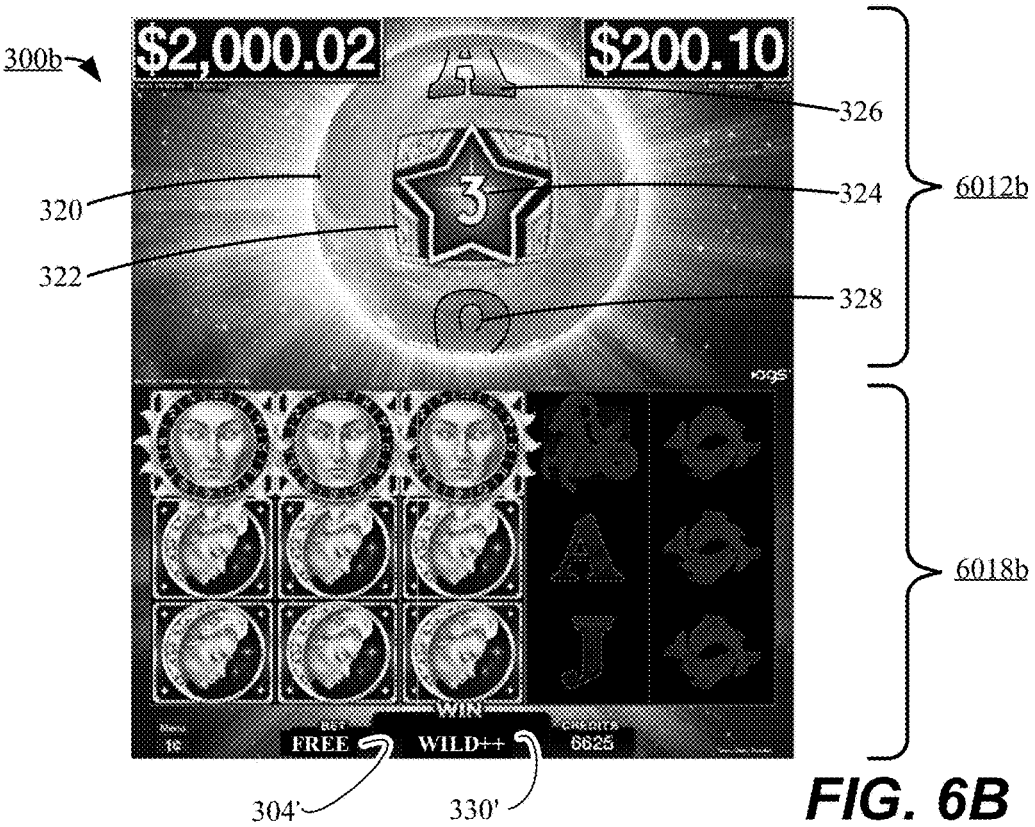

Referring to FIG. 6B, shown is a subsequent second state 300*b* of the illustrated "Celestial Fortunes" game. Although the intermediate animation is not shown, it is to be understood that between first state 300*a* and second state 300*b*, the blazing sun symbol 309 morphed into a spinning chance ball (or into a fortune-telling sphere having an internally spinning reel) 320 having various symbols on its spun surface such as the Ace symbol shown at 326 and the "8" symbol shown at 328. At the completion of the spinning of the chance ball 320, a WILD++ symbol showed up as its selected outcome as shown at 322. In this example, the WILD++ symbol 322 is in the form of a five pointed star. Inside the star is an integer indicating a number of Wild symbols that are next to be scattered awarded to the player. In the instant example, the Wild symbols are also five pointed stars. At the lower portion of lower display area 6018*b*, area 304' may indicate that a series of free spins has been awarded and area 330' may indicate that a WILD++ state has been encountered by chance in the upper display portion 6012*b*. The indication of the WILD++ state may be accompanied by various fanfare graphics and sounds. In one embodiment (not shown) area 304' may indicate which spin of the awarded series of free spins is currently being shown; for example free spin 3 of 10. Since of the spins in the series are each free, the player does not have to wager any amount in between and one free spin can automatically follow a previous free spin with appropriate intermission between them such that the player (and bystanders if any) can appreciate the outcome of each free spin. In an alternate embodiment, the player may be asked to press a button to actuate the next free spin.

Figure 6C:
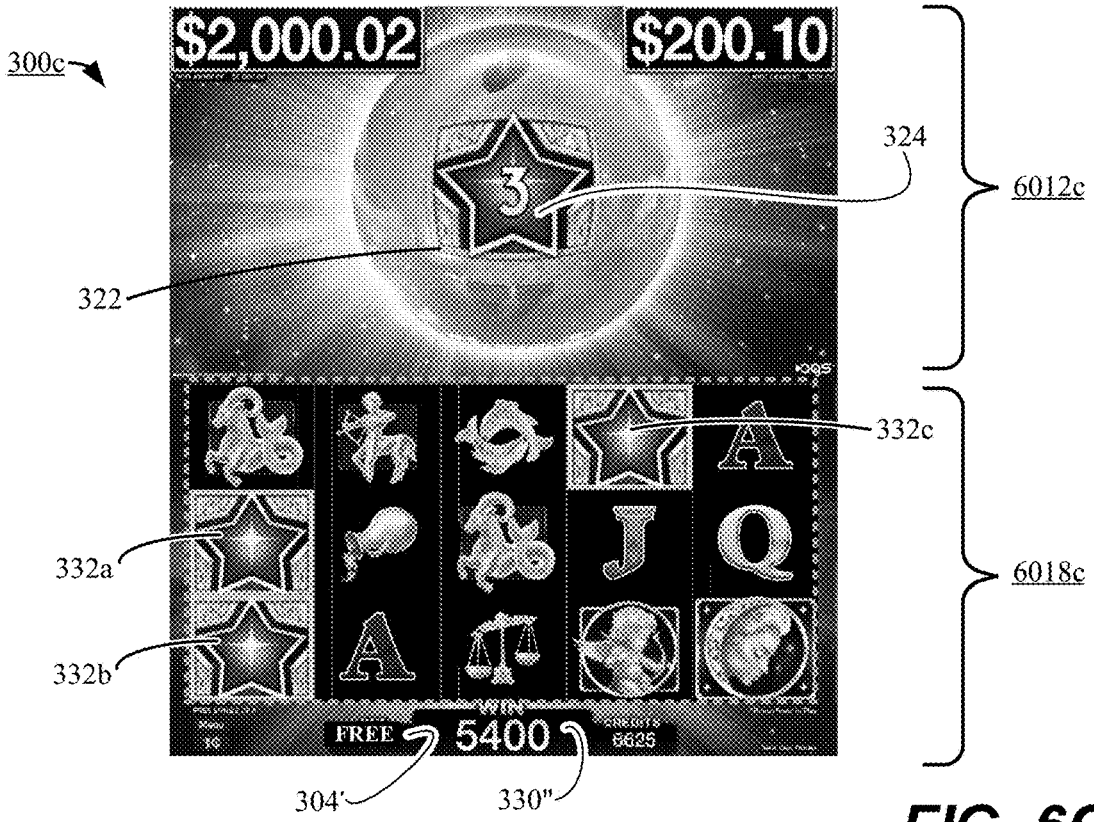

Referring to FIG. 6C, and more specifically to the lower display portion 6018*c* thereof, illustrated is the outcome of scatter distribution of the awarded three bonus Wild symbols 332*a*, 332*b*, and 332*c*. The illustrated example assumes that at least one of the awarded three bonus Wild symbols 332*a*, 332*b*, and 332*c* produced a winning combination and thus the win area 330" is no longer blank and instead shows a winning of for example, 5400 credits. The displaying of this won amount may be accompanied by appropriate fanfare. Additionally in the animated interim between the third machine state 300*c* shown in FIG. 6C and the second state 300*b* shown in corresponding FIG. 6B, the graphics for the award count 324 may have morphed into a train of three Wild symbols that animation-wise snake their way down from the upper display portion 6012*c* to the lower display portion 6018*c* so as to be scattered distributed by chance into respective cells of the game outcome grid (a 3×5 grid in this example). Although not shown, in one example, at the end of the morphing; the award count 324 increments into a higher number (e.g., 4) and then fades away, leaving behind an empty five pointed star symbol at 322. The next time the chance ball 320 spins and the WILD++ symbol 322 appears, it will contain the incremented-to higher number (e.g., 4). Then the chance ball 320 itself starts to fade and morphs back into the blazing sun symbol 309 shown in FIG. 6A, ready for the next free spin if any is left.

Figure 6D:
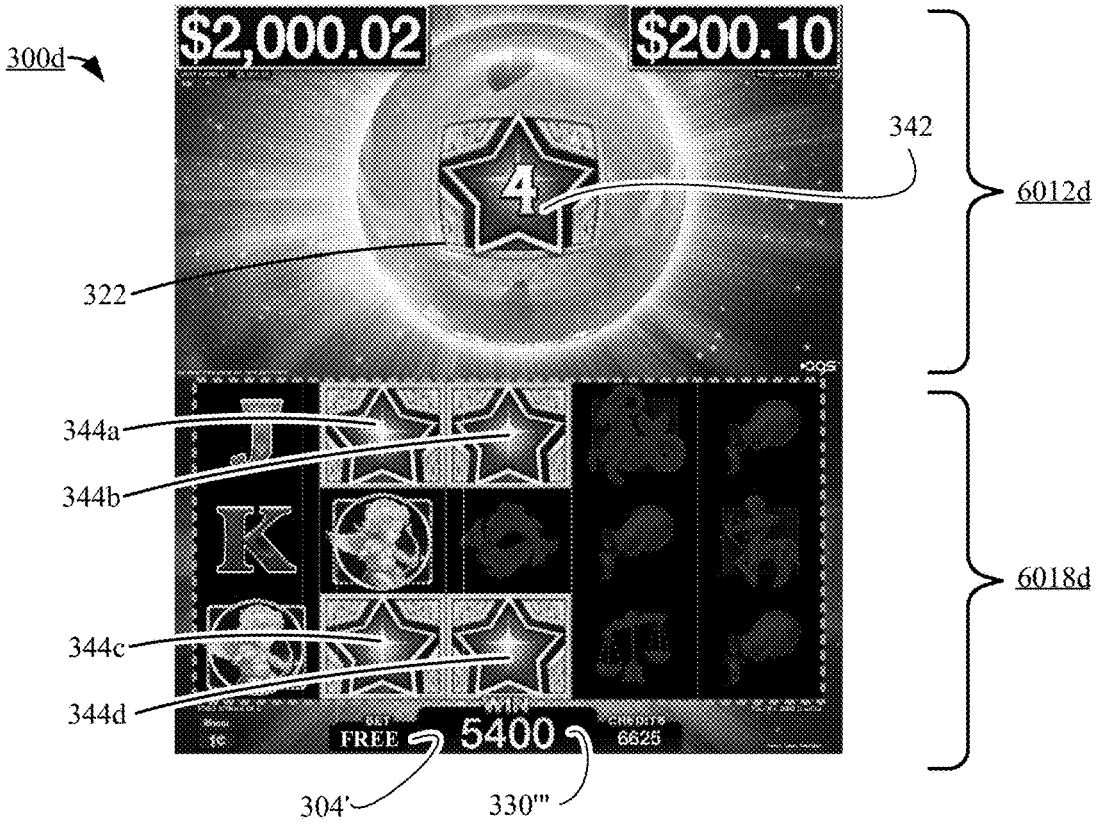

Referring to FIG. 6D, shown is a subsequent machine state 300*d* which occurs after the next time that lucky symbol set 310 appears and the blazing sun symbol 309 again morphs into the spinning chance ball 320 and the chance ball lands on the WILD++ symbol 322. However as shown in FIG. 6D, this time the award count 342 is the higher value (e.g., 4) and accordingly four bonus Wild symbols 344*a*, 344*b*, 344*c* and 344*d* have been awarded and scattered distributed by chance into the game outcome grid. The illustrated example assumes that at least one of the awarded four bonus Wild symbols 344*a*, 344*b*, 344*c* and 344*d* produced a winning combination and thus the win area 330" is no longer blank and instead shows a winning of for example, 5400 credits. The displaying of this won amount may be accompanied by appropriate fanfare. Additionally in the animated interim between the fourth machine state 300*d* shown in FIG. 6C and a previous state corresponding to the second state 300*b* of FIG. 6B, the graphics for the award count 342 may have morphed into a train of four Wild symbols that animation-wise snake their way down from the upper display portion 6012*d* to the lower display portion 6018*d* so as to be scattered distributed by chance into respective cells of the game outcome grid (a 3×5 grid in this example). Although not shown, in one example, at the end of the morphing; the award count 342 increments into a higher number (e.g., 5) and then fades away, leaving behind an empty five pointed star symbol at 322. The next time the chance ball 320 spins and the WILD++ symbol 322 appears, it will contain the incremented-to higher number (e.g., 5). Then in FIG. 6D the chance ball 320 itself starts to fade and morphs back into the blazing sun symbol 309 shown in FIG. 6A, ready for the next free spin if any is left.

Figure 7A:
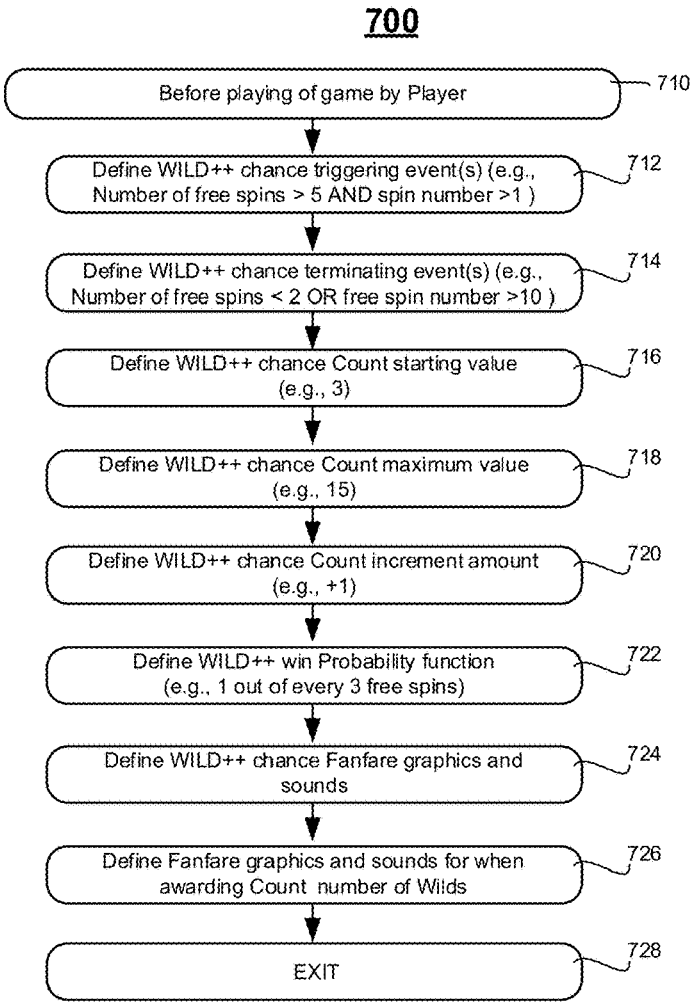
FIG. 7A depicts a machine-implemented method of configuring a wagering system to provide progressively increasing numbers of chance awarded bonus wilds in accordance with the present disclosure.

Referring to FIG. 7A, a first computer implemented method 700 is illustrated as being carried out before a particular type of game is played. It is to be understood that portions or wholes of the machine-implemented methods of FIGS. 7A and 7B (described below) can be carried out by one or more processors disposed locally in the gaming machine 1002 or distributed about a network of data processing machines, including for example the servers depicted in FIG. 2. Preferably the processors and associated memories, I/O modules and other peripherals thereof are secured in tamper proof housings and/or packages and are inspectable for verifying that they operate as advertised, including providing gaming actions of chance with respective advertised probabilities of chance driven events.

Entry into method 700 is made at step 710. In one embodiment all these pre-game determinations are stored in a secured nonvolatile memory. At step 712 a determination or definition of one or more triggering events for one or more WILD++ chances is obtained and stored in an appropriate game control storage. By way of non-limiting example, one such determined triggering event is detection that a number of free spins have been awarded where the initial number of awarded free spins is greater than five and also that the current spin number among the awarded number of spins is greater than one. Other values and conditional combinations may of course be used.

In subsequent step 714, a determination or definition of one or more terminating events for the one or more WILD++ chances is obtained and stored in an appropriate game control storage. By way of non-limiting example, one such determined set of terminating events is that satisfying the condition that the remaining number of free spins is less than two OR the current spin number among the series of spins is greater than ten. A variety of further terminating events may be determined, including for example, detection that the player has left the gaming machine and/or that the player has terminated playing the game even though he/she still had a number of free spins to go. Whenever the triggered WILD++ chances state is terminated, it reverts back to an initial state having the lowest count starting value for the bonus wilds as shall be next described.

In step 716, a determination or definition of the initial count value for the triggered one or more WILD++ chances is obtained and stored in an appropriate game control storage. By way of non-limiting example, one such determined starting count value can be the integer three. Typically, awarding just one bonus wild symbol does not tend to generate too much player excitement because the likelihood that scattered distribution of an awarded one wild symbol will do any good is relatively low. On the other hand as the automatically incremented count for the next award of bonus wild symbols rises to values closer to the total cell count of the game output grid (e.g., a total of 15 for a 3×5 grid structure), the expectation of a winning combination grows dramatically and so can the entertainment value provided to the player.

In step 718, a determination or definition of the maximum count value for the triggered one or more WILD++ chances is obtained and stored in an appropriate game control storage. Typically this maximum count value will equal the total cell count of the game output grid (e.g., a total of 15 for a 3×5 grid structure). It makes no sense to try to scattered deposited more bonus wild symbols than there are symbol containing cells in the grid area. In some embodiments, the maximum count value may be set to less than the total cell count of the game output grid; for example to a value which is less than the total cell count by an integer in the range 1-5.

In step 720, a determination or definition of the value by which the WILD++ chance count will be incremented each time a successful WILD++ chance outcome is encountered is obtained and stored in an appropriate game control storage. Typically the incremented amount is set to one. However, for some games (e.g., ones with relatively large N×M game outcome grids), the incremented amount may be set to two or greater.

In step 722, a determination or definition of the probability function to be used for when a WILD++ win will occur by chance is obtained and stored in an appropriate game control storage. By way of non-limiting example, such a probability function may cause the WILD++ wins to occur roughly one out of every three free spins. If the probability of a WILD++ win is set too low, then players will have reduced expectation of winning credits based on the incremented next bonus count amount. On the other hand if the probability of a WILD++ win is set too high; say near 100%, then there will be no excitement generated for the player as compared to when the event of a WILD++ win (which aborts the bonus amount of wildcards) is less than 50% but greater than 10% (as an example).

In step 724, a determination or definition of the fanfare that will be used when WILD++ chance is presented during a series of free spins is obtained and stored in an appropriate game control storage. Such WILD++ chance presentation fanfare may include gestures by an animated character and the sounding of bells, gongs or other sound effects.

In step 726, a determination or definition of the fanfare that will be used when WILD++ win occurs (when bonus Wilds are awarded) is obtained and stored in an appropriate game control storage. The fanfare graphics may define the manner in which the bonus Wilds emerge from the area where the WILD++ special symbol is displayed and the manner in which they move downwards for scattered distribution into the cells of the active game outcome array (e.g., the 3×5 grid).

In one embodiment, the pre-game set up routine 700 exits at step 728. It is within the contemplation of the present disclosure that additional or more detailed set up configurations take place before the given type of game is played.

Figure 7B:
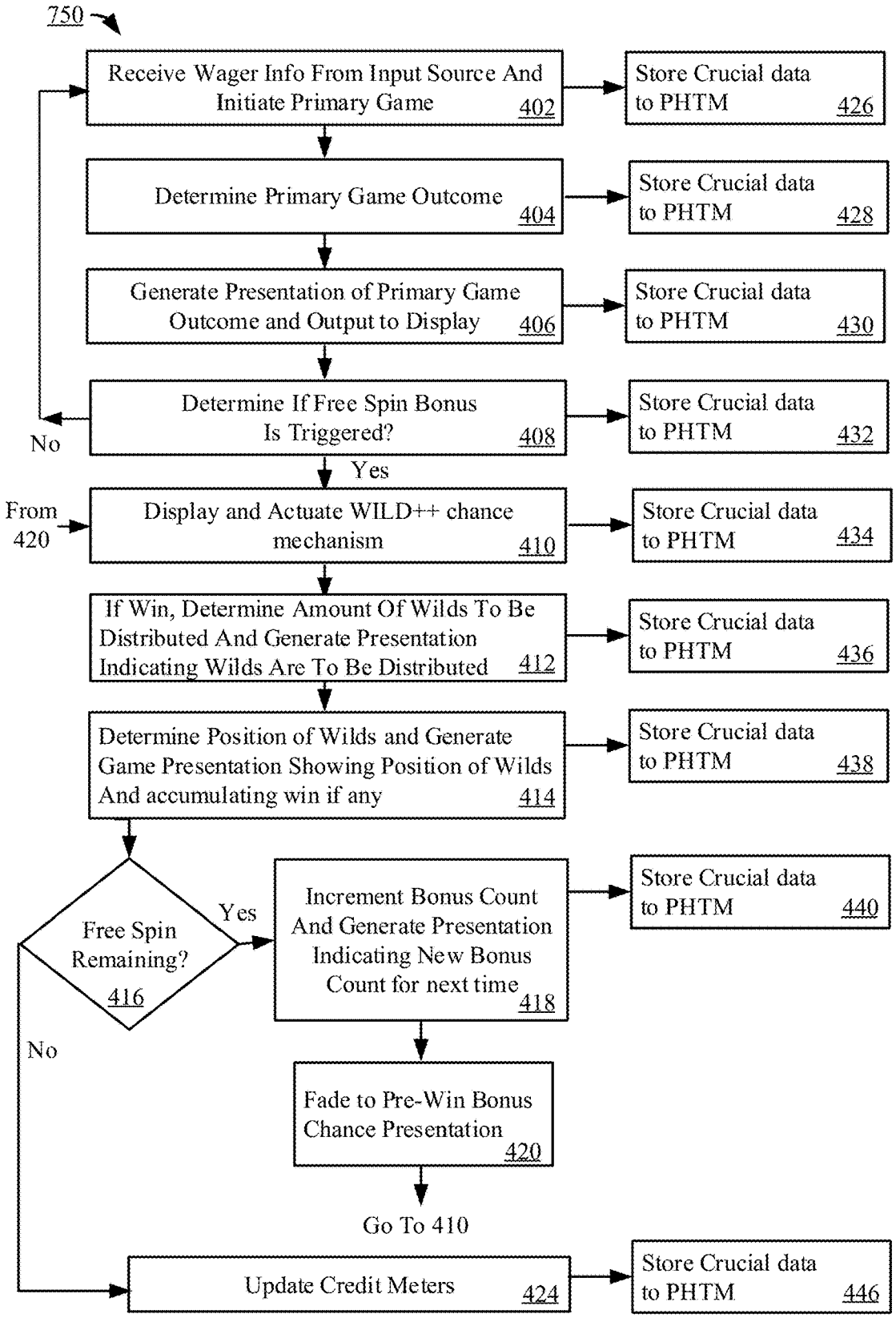
FIG. 7B illustrates a machine-implemented method of playing a free spin bonus game including wild symbols accumulation and distribution in accordance with the present disclosure.

Referring next to FIG. 7B, illustrated is a flow chart for a second machine-implemented process 750. This second process occurs while the given type of game is being played. Step 402 occurs while not in a free spins scenario. The gaming machine receives wagering information (e.g., amounts bet, number and types of pay lines to be used) from the player by way of appropriate input mechanisms (e.g., touch screens, buttons and/or from the player's mobile device). Then the wagered upon and non-free game action is initiated. Sidestep 426 represents the storage into secured nonvolatile memory of at least the crucial data involved in the placing of the wagers and the initiation of the gaming action.

In step 404, the outcome of the initiated gaming action is determined. In step 406, the outcome of the finished gaming action is presented by way of appropriate outputs (e.g., on the lower display area of the gaming machine and or on the player's mobile device).

In step 408, based on previous game playing activity by the player a determination is made based on chance if a series of free spins will be awarded to the player. Typically the number of awarded free spins is in the range of 6 to 12, and nominally around 10. If no, control returns to step 402 four repeat of steps 402 to 408. If yes, control continues into step 410 in which the WILD++ chance mechanism is displayed and actuated. By way of non-limiting examples, such a displayed chance mechanism could be the horizontally circulating reel 1012*h* of FIG. 1, or the free bonus chance wheel 204 of FIG. 5A, or the spinning sphere 320 of FIG. 6B.

If the actuated WILD++ chance mechanism produces a winning outcome (e.g., 204" of FIG. 5B) then in step 412 a determination is made of the number of bonus Wilds to be currently distributed an appropriate graphics and/or sound effects are generated and presented to indicate that the determined number of bonus Wilds are being scattered distributed into the primary game outcome array. If the actuated WILD++ chance mechanism does not produce a winning outcome, and there are still free spins remaining (test step 416) then control returns to step 420 four displaying the pre-win WILD++ chance mechanism, where after control continues into step 410.

In step 414, a determination is made of where in the primary outcome array the generated bonus Wilds will be placed and the primary outcome array is thereafter displayed with the placed bonus Wilds. If a winning combination is created by the placed bonus Wilds, the appropriate credit is added to an accumulating credit amount for the player based on the awarded series of free spins. Test step 416 determines if there are any further free spins remaining (and in one embodiment, if there are enough of them) and if yes, control continues into step 418 where the bonus count for the next time is incremented and the incremented bonus count is to put displayed to the player such that the player can anticipate likelihood of a greater win the next time the WILD++ chance mechanism awards him additional bonus Wilds. In step 420, the upper display area fades into showing the pre-win WILD++ chance mechanism. One example of this is wheel 204' as shown in FIG. 5C control then continues into step 410.

If the outcome of test step 416 is no, control continues into step 424 where the accumulated credits from the free spins are added into the previous credit amounts stored in the credit meters. Has true for the cases of others of the steps in the process 750, crucial data is stored into the secured nonvolatile memory inside step 446. Control then returns to step 402 if the player has not terminated playing at the gaming machine.

Figure 7C:
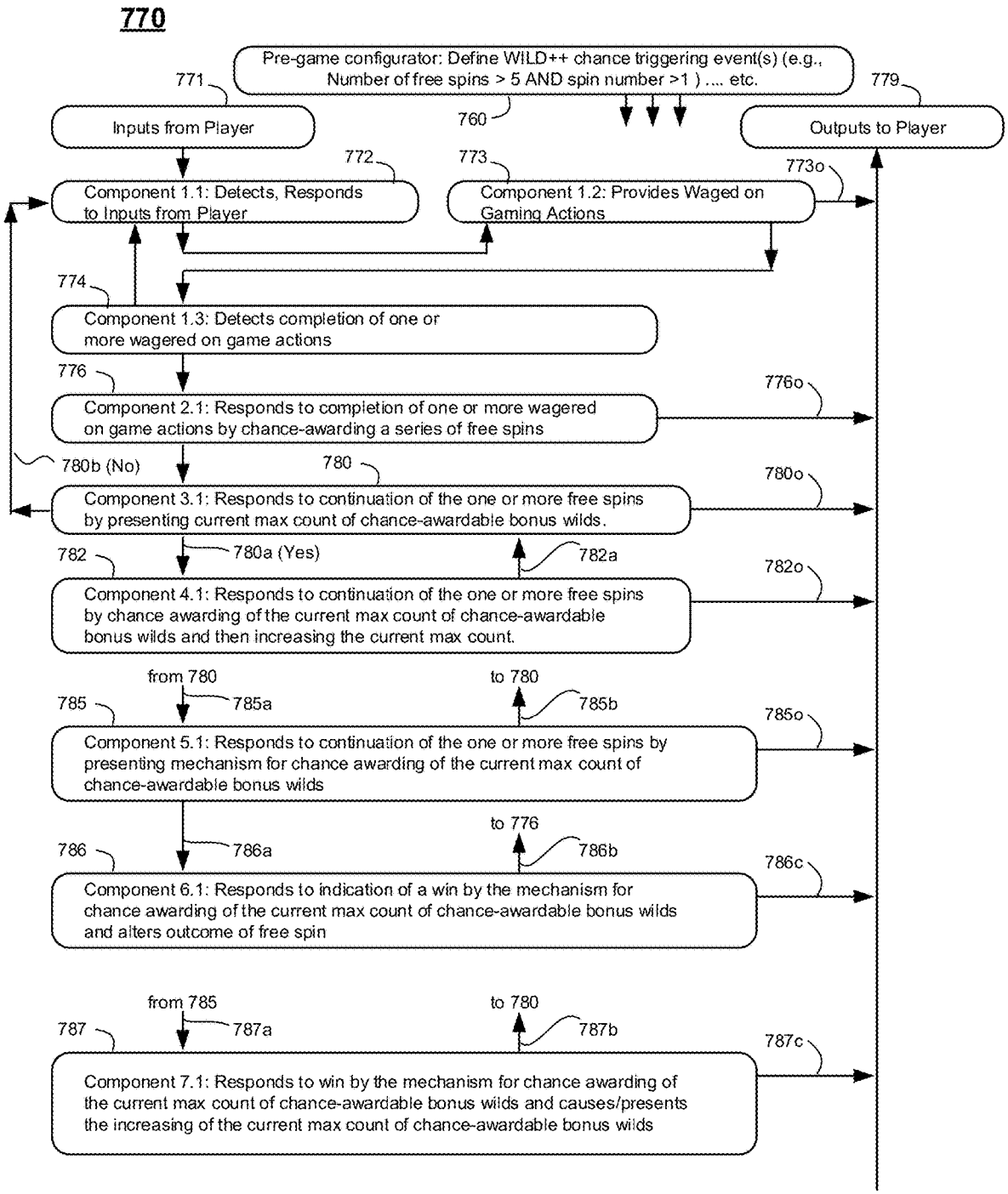
FIG. 7C depicts a machine system configured to provide progressively increasing numbers of chance awarded bonus wilds in accordance with the present disclosure.

Referring to FIG. 7C, illustrated are various components of a machine system configured to carry out one or more aspects of the present disclosure. The components can include mechanical mechanisms and/or electronic mechanisms for providing chance-based game outcomes in particular, the electronic mechanisms may include hardware components, firmware components and/or software instructions encoded into non-transitory computer readable storage and configured to cause an associated one or more processors to carry out the operations defined by those software instructions. More specifically, FIG. 7C depicts a machine system 770 having an initiator component 760 which upon power up or reset establishes initial conditions for various others of the components, for example in accordance with the initial configuration method 700 of FIG. 7A. The components of machine system 770 include one or more player input mechanisms 771 configured for receiving various inputs from the player including those defining desired games to be wagered on. As indicated above, these various input mechanisms may include buttons or touch screens, levers, input devices provided on the player's mobile device (including voice, gesture and fingerprint input recognizing devices).

The components of machine system 770 also include one or more player output mechanisms 779 configured for outputting various signals to the player including those graphically and/or audibly representing the games that are being wagered upon. As indicated above, these various player output mechanisms may include video displays, audio outputs, flashing lights, spinning mechanical wheels or reels, tactile outputs (e.g., vibrators) and so on.

A further or first machine component 772 of system 770 is configured to receive from at least one of the input mechanisms 771, an indication of a player submitted wager. Component 773 is operatively coupled to component 772 to responsively cause actuation of a first gaming action corresponding to the submitted wager. The first gaming action may be output by way of path 773*o* to the player outputs mechanism 779. Component 774 detects completion of each gaming action and signals that completion to both of components 772 and 776. The latter or second component 776 response to the completion signal by chance awarding a series of free spins. If the free spins are awarded, component 772 is temporarily blocked from responding to most user inputs until the awarded series of free spins completes. (Some embodiments may include a free spins override button where the player chooses to bypass the awarded free spins.) Presentation of the awarded free spins may be supplied to the output mechanisms 779 by way of signaling path 776*o*.

A third of the machine components, 780, is coupled to the second machine component 776 and configured to detect initiation of the first series of free spin gaming actions and during the first series of free spin gaming actions, to cause presentation of a non-zero first count of bonus wilds that can be made available by-chance for insertion into at least a first of the free spin gaming actions of the first series. One of the possibilities is that none of the free spins provides a chance awarding of bonus wild cards. If that is so, control passes by way of path 780*b* (No) back up to component 772 which is reactivated to receive further wagers from the player. Typically however, the chance of receiving bonus Wilds is initiated to around 33% and the number of awarded free spins is set to around 10 so that typically, the player will be awarded bonus Wilds. When a chance for bonus Wilds is being presented (by way of control path 780*a*—Yes) control passes to a fourth of the machine components, 782, which is coupled to the third machine component to detect continuation of the first series of free spin gaming actions and during the continuation of the first series of free spin gaming actions but after said causing of the presentation of the first count, to cause presentation of a second count of bonus wilds that can be made available by-chance for insertion into at least a second of the free spin gaming actions of the first series, the second count being greater than the first count. The output of fourth component 782 may be signaled to the player output mechanisms 779 by way of signaling path 782*o*. In one embodiment, the fourth machine component 782 is further configured to, during the continuation of the first series of free spin gaming actions but after said causing of the presentation of the second count, to cause presentation of a third count of bonus wilds that can be made available by-chance for insertion into at least a third of the free spin gaming actions of the first series, the third count being greater than the second count. In one embodiment, the first gaming action provided by component 773 includes an apparent spinning of chance reels or wheels whose chance settlement outcome can provide a winning combination of symbols along an active payline of the first gaming action. In one embodiment, the first series of free spin gaming actions provided by component 776 includes an apparent spinning of chance reels or wheels whose chance settlement outcome can provide a winning combination of symbols along an active payline of at least one of the free spin gaming actions. The first count of by-chance insertable wilds are operable to improve a chance of winning of the at least first of the free spin gaming actions if inserted along an active payline of said at least first of the free spin gaming actions. The second count of by-chance insertable wilds are operable to improve a chance of winning of the at least second of the free spin gaming actions if inserted along an active payline of said at least second of the free spin gaming actions.

Illustrated machine system 770 further includes a fifth machine component 785 which is coupled to the third machine component 780 to detect a non-completion of one of the first series of free spin gaming actions, and is configured to cause before completion of said one of the first series of free spin gaming actions, a presentation and subsequent actuation of a first chance mechanism having at least one chance outcome that results in insertion into the outcome of the said one of the first of the free spin gaming actions of said first count of by-chance insertable wilds. The system 770 also includes a sixth machine component 786 which is coupled to the fifth machine component to detect the at least one chance outcome that results in insertion and to responsively produce an outcome of the said one of the first series of free spin gaming actions that includes said insertion of the first count of by-chance insertable wilds. Also included is a seventh machine component 787 which is coupled to the fifth machine component to detect the at least one chance outcome that results in insertion and to responsively cause presentation of graphics indicating to the player that the first count has been replaced by the larger second count. As indicated in FIG. 7C, respective components 785, 786 and 787 have respective output signaling lines 785*o*, 786*c* and 787*c* operatively coupled to the player output mechanisms 779 for optionally outputting their respective results. Completion of actions by components 785 and 787 results in return of control to component 780 by way of respective return paths 785*b* and 787*b*. Completion of actions by component 786 results in return of control to component 776 by way of respective return path 786*b*.

The components of the machine system 770 may be housed in a single secured housing (e.g., locked cabinet) or may be distributed in various ways among a plurality of spaced apart and secured locations and coupled to one another by appropriate secured communication links. While a particular arrangement of components is illustrated in FIG. 7C, it is to be understood that this is merely exemplary and that operations in accordance with the present teachings may be carried out with use of alternate arrangements of hardware, firmware, software and/or mechanical components.

Figure 8:
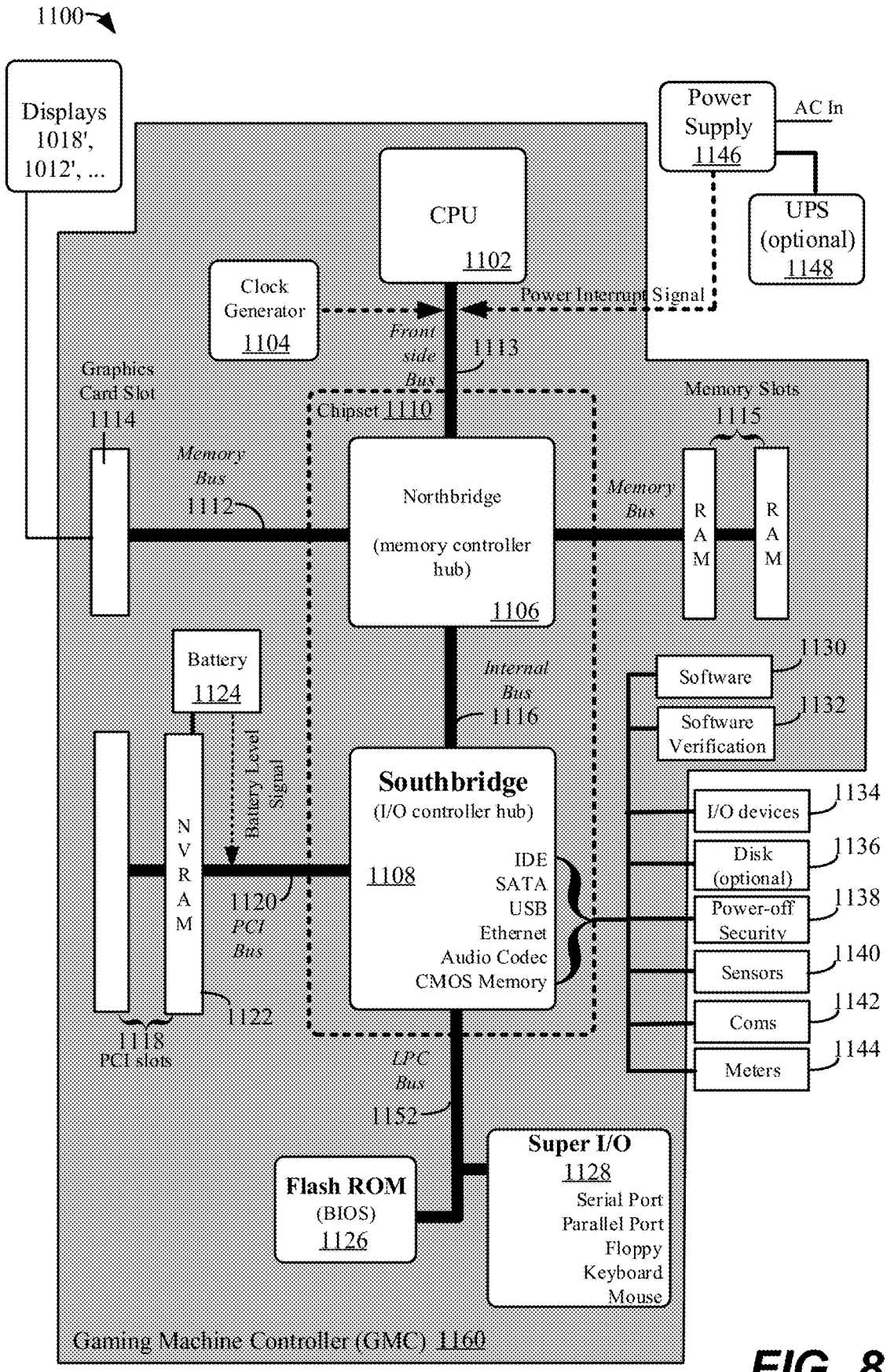
FIG. 8 illustrates a block diagram of gaming machine components including a gaming machine controller in accordance with the present disclosure.

Next, with respect to FIG. 8, details of a gaming machine controller that may be used to control the play of wager-based games including generating the game presentations and controlling the various gaming devices is described. FIG. 8 illustrates a block diagram of gaming machine components including a securely housed gaming machine controller (GMC) 1160. The GMC 1160 can be coupled to an external power supply 1146, displays such as 1018' 1012; etc., I/O devices 1134, external non-transient memories, such as a disk drive 1136, a power-off security device 1138, security sensors 1140, communication interfaces 1142 and meters 1144.

The external power supply 1146 can provide a DC voltage to the GMC 1160. The power supply can also provide power to the other devices in the gaming machine cabinet, such as I/O devices. Typically, the power supply 1146 is configured to receive power from an external power source, such as an AC voltage source. In some embodiments, an uninterruptable power supply (UPS) 1148 can be coupled to the power supply 1146. The UPS 1148 can be configured to provide back-up power for some time period in the event external power is lost. The GMC 1160 includes its own internal and thus securely housed battery 1124 (e.g., a rechargeable battery).

In a particular embodiment, the UPS 1148 communicates with the GMC 1160 on boot up and periodically to indicate power status and battery capacity of the UPS. If the UPS 1148 is not operational, this communication will fail and the game will display a soft tilt on the main game display, such as 1018', indicating that the UPS is not available. Under normal circumstances the UPS 1148 functions to condition the input power and ensure that the UPS battery remains fully charged. However, upon a power failure, the UPS 1148 in conjunction with the game platform will take one of two paths depending on the state of the UPS battery, which are described as follows.

If a power fail occurs and the UPS battery is more that 50% charged the GMC 1160 can immediately determine if there are credits on the machine (The threshold level can be a different percentage). If the game has no credits, the GMC 1160 can immediately hard tilt and become unplayable. The GMC 1160 can continue to run on battery power until either the battery level passes below 50% or power is restored to the game. If power is restored, the hard tilt is cleared and the gaming machine can become playable again.

If credits are on the machine, the GMC 1160 can allow game play to continue until the battery level reaches 50% charge. At that point, the GMC 1160 can complete a game in progress, cash out the player and begin an orderly shutdown. Allowing game play prior to shutting down allows the player to complete a game in progress and continue to remain on the game for a small period of time in case power is restored quickly. This keeps the game from tilting and the GMC 1160 cashing out the player for momentary glitches in power. It also allows some time for backup generators to come on line for a more serious power outage.

The power-off security 1138 can be configured to monitor the security sensors 1140 while power is off to the gaming machine, such as during a power failure or shipping. The power-off security 1138 can include its own processor, memory and power supply, such as the internal battery 1124. The power-off security device 1138 can report detected problems while the power was off to the GMC 1160 after power is restored. In some instances, a detected problem can cause a tilt condition. For example, a detected door open condition while the power was off may cause a tilt condition which has to be cleared by an operator. As another example, if the GMC 1160 can't detect the power-off security 1138, then the gaming machine can tilt.

The I/O devices 1134 can include the gaming devices that are directly or indirectly coupled to the GMC 1160 to provide the external interfaces that allow players to play the wager-based game(s) on the gaming machine. Examples of these gaming devices are described above with respect to FIG. 1. In some embodiments, a memory device 1136, such as disk drive and/or a flash drive, can be provided. As will be described in more detail below, the memory device 1136 can be used as a power hit tolerant memory (PHTM) or used to receive crucial data from another PHTM.

The communication interfaces 1142 can include wired and wireless communication interfaces, which use communication protocols, such as but not limited to Ethernet, Bluetooth,™ Wi-Fi, and NFC. A schematic indication of such a wireless communication interface 1046 is shown in FIG. 1. The remote servers can provide network services 1004 as described above with respect to FIG. 1. The communication interfaces can be used to communicate with remote devices, such as remote servers, mobile devices in proximity to the gaming machine or other gaming machines. The GMC 1160 can be configured to support a variety of communication protocols over these communication interfaces.

In one embodiment, communications can be carried out with a back-end slot accounting system (SAS) (e.g., see network services 1004 in FIG. 1). In one embodiment, the SAS protocol uses a CRC redundancy check to ensure the integrity of messages going to and from the host. All type S, M, and G Long polls are CRC'd over the entire package including the address and command byte. The SAS engine can be configured to isolate the gaming code from the external communications. The SAS engine can be configured to only accept correctly formed SAS messages. Malformed, invalid or incorrect messages can be summarily dropped.

Messages that are valid can be translated into requests for the game player. The result of the message translation can be two-fold. First, the message is parsed and then evaluated for correctness and validity. If the message does not meet this criterion, it may not be translated and forwarded to the game player for a response, such as on display 1026 in FIG. 1. Second, no command, request or message from the external communication interface ever reaches any further than the SAS engine. This process ensures that erroneous signals or data will not adversely affect the game.

The meters 1144 can include hard meters, which are mechanical devices and meters maintained in software by the GMC 1160. In one embodiment, electronic digital storage meters of at least 10 digits that accumulate and store all the meters required can be used. For example, the number of games played since a RAM clear can be accumulated. In a RAM clear, critical memory can be cleared of data. Further, the number of games since the last power-up can be accumulated. As another example, games since the last door close can be accumulated.

Some other functions which may be tracked by a physical or software meter include but are not limited to attendant paid jackpots, attendant paid cancelled credits, bill in, voucher in (e.g., credit voucher), voucher out, electronic fund transfer in, wagering account transfer in, wagering account transfer out, non-cashable electronic promotion in, cashable electronic promotion in, cashable promotion credits wagered, non-cashable electronic promotion out, cashable electronic promotion out, coupon promotion in, coupon promotion out, machine paid external bonus payout, attendant paid external bonus payout, attendant paid progressive payout, machine paid progressive payout, non-cashable promotion credits wagered, number of progressives won, number of jackpots won, number of games won, number of games lost and total amount paid by attendant. Other meters can include main door open, logic door open, cash door open and stacker door open.

In a particular embodiment, software meters can be accessed from an operator menu by turning a key on the side of the gaming machine. The operator menu can be output on display 1150. All software meters can be cleared upon a RAM clear. In addition to the meters, the machine can also display the configured denomination, theoretical payout and actual payout. This information is accessible from the operator menu under the statistics screen. This information can be cleared upon a RAM clear event.

The GMC 1160 is preferably secured within an interior of the gaming machine. For example the GMC 1160 can be contained in a metal box. The metal box can include a secure entry, such as a hinged door, that is lockable. The openings for cables and wiring in the metal box can be purposefully designed to be as small as possible while still allowing proper electrical wiring standards regarding bend radius and connector strain. The locking mechanism for the metal box can be monitored by one of the sensors 1140.

The GMC 1160 can include a motherboard. The motherboard can be the only circuit card that contains control programs. The control programs include those used to control programmable operations within the GMC 1160. Other gaming devices, such as the I/O devices 1134, can include device specific control programs. However, these device specific control programs don't affect or alter the behavior of the control programs on the motherboard.

The mother board can include a chipset 1110. The chipset 1110 can include a Northbridge 1106, which is a memory controller hub, and a Southbridge 1108, which is an I/O controller hub. The Northbridge 1106 and the Southbridge 1108 can communicate via an internal bus 1116.

The Northbridge 1106 can be coupled to a memory bus 1112 and a front side bus 1113. The front side bus 1113 can couple on or more processors, such as CPU 1102, to the Northbridge 1106. The CPU 1102 can receive clock signals from clock generator 1104 via the front side bus 1113.

The memory bus 1112 can couple one or more graphics cards, which include graphical processing units (GPUs), to the Northbridge 1106. The graphics card or cards can be installed in the graphics card slot(s). The graphics cards can be coupled to displays, such as display 1018'. Further, the memory bus 1112 can couple one or more memory slots 1115, configured to receive volatile random access memory, to the Northbridge 1102. The CPU 1102 can communicate with the volatile memory in the memory slots 1115 and the graphics card in the graphics card slot 1114 via the memory bus 1112 and the front side bus 1113.

The Southbridge 1108 can be coupled to one or more PCI slots 1118 via PCI bus 1120. In various embodiments, the Southbridge 1108 can provide a variety of communications interfaces. The communication interfaces include but are not limited to IDE, SATA, USB, Ethernet, an audio Codec and CMOS memory. In addition, the Southbridge can communicate with a flash ROM (BIOS) 1126 and super I/O 1128 via the LPC (Low Pin Count) bus 1152. Typically, super I/O 1128 supports older legacy devices, such as a serial port (UART), a parallel port, a floppy disk, keyboard and mouse. Some of the gaming devices, such as the sensors 1140, can be coupled to the Southbridge 1108 via super I/O 1128.

The GMC 1160 can be configured to execute gaming software 1130 to control playing of a respective one or more wager-based games. On boot-up, software verification 1132 can be performed using logic stored on the BIOS 1126. In some instances, the logic can also be executed on the BIOS. In a particular embodiment, separate hardware device can be installed which includes verification algorithms. The separate hardware device can be coupled to the Southbridge 1108.

In one embodiment, the gaming software 1130 can be stored on two compact flash cards, which are not conventional ROM devices. The verification mechanism can be an SHA-1 hash, which produces a message digest of some length, such as one hundred sixty bits. Message digests can be stored on both compact flash memories and a public/private key algorithm with a key of some length, such as a 512-bit key, can used to encrypt and decrypt the message digests. If any errors are detected in the validation, the GMC 1160 can tilt and halt execution. The GMC 1160 can be configured to prevent programs deemed to be invalid from running.

When the software 1130 is built, it can be hashed using a hash algorithm, such as an SHA-1 hash algorithm. Other hashing algorithms can be used and SHA-1 is provided for illustrative purposes only. The resulting hash answers can form the hash digest. This digest, along with the start and stop values for the validation algorithm, can be encrypted a private key. The key can be stored in a computer which is not connected to any network and which is physically stored in a secure location, such as a locked safe.

In one embodiment, prior to use, the public key can be installed in a power-hit tolerant memory, such as the NVRAM 1122 on the motherboard. This step can be performed when the gaming machine is manufactured. In another embodiment, the public key can be loaded from a memory device, such as a USB device, in the field. In one embodiment, the USB port is only accessible when the enclosure which holds the GMC 1160 is opened. Without a proper public key, the machine will not operate.

When the game initially powers up, the BIOS 1126 can run a Power On Self-Test (POST) and checksum over itself. If these tests fail, the game does not boot and an operator can be required to clear this tilt. If the BIOS self-test passes, the BIOS can retrieve the public key from NVRAM 1122 and can run a CRC over it to ensure it is the correct key. The correct CRC answer can be stored on the BIOS. If the public key does not exist or if the public key CRC returns an incorrect answer, the game can halt and prompt the user to install the correct public key.

Once the public key is validated, the BIOS 1126 can decrypt the SHA signatures for the data stored on the system compact flash 1130 and the start and stop sectors indicating where the data is stored on the compact flash. The data can be stored between the start and stop sectors, inclusive. Unused sectors can be set to 0 (zero). The BIOS 1126 runs a low-level block-by-block SHA-1 hash over the kernel and operating system (Boot and Root) partitions and compares the result to the decrypted file from the manifest. In one embodiment, the operating system can be Linux and the kernel can be a Linux kernel. If the hash values do not match, the game tilts.

If the values match, the BIOS 1126 can load the boot loader program and can relinquish control of the validation process to the boot loader. The boot loader can be executed by the operating system using CPU 1102. The procedure can validate the entire partition, not just the file structure. Thus any unused or unallocated areas of the partition can be tested for unintended programs or data.

Next, a file-by-file SHA-1 can be performed over the paytable, assets, and player files. The resulting information can be compared against the decrypted results from the manifest file. If the calculated answers match the decrypted answers, the GMC will proceed with the boot-up. If the hash answers do not match, the game tilts and requires operator intervention to clear.

In one embodiment, as an additional security measure, a compressed file system that is designed to be read-only can be used. The file system may not support or contain a write command or the ability to write to a file. The file system can be compressed so that it is not human-readable.

Each block of data in the file system can have a corresponding CRC stored with the block. When the block is read, the CRC is calculated and compared with the stored CRC. If the answer does not match, the file system can generate an error and the game tilts. Any changes, whether additions, deletions, or modifications, will change the CRC of the affected blocks and cause the game to tilt. This feature, in effect, monitors the integrity of the entire file system as well as the integrity of the media on a real-time basis.

These SHA hash answers can be available on-screen and may also be accessed via the Gaming Authentication Terminal (GAT) interface. The GAT interface (not shown) can be provided as one of the I/O devices 1134 or within the super I/O 1128. The GAT interface can be configured to allow an operator to initiate an SHA-1 hash or an HMAC SHA-1 on-demand so that an operator (or other independent entity) can validate the integrity of the software 1130 at any time. In one embodiment, a nine-pin "D" connector is available to an operator or regulator for access the GAT serial terminal.

Access to the GAT port requires opening of the main door. Further, it may require unlocking of the GMC enclosure. In one embodiment, a GAT port can be provided on the outside of the GMC enclosure. Hence, the GMC enclosure can remain locked while the GAT port is utilized.

As described above, the gaming machine can include a power hit tolerant memory (PHTM). For example, NVRAM 1122 (nonvolatile memory, for example a RAM coupled to battery 1124) can be used as a PHTM. The PHTM can be used to store crucial data, such as data generated during the play of a wager-based game. The PHTM can be configured to be able to quickly write the crucial data in response to a detection of an imminent power interruption. The CPU 1102 can be configured to detect a potential power interruption via the power interruption signal received from the power supply. The power interruption signal can indicate a fluctuation in the power.

Not all memory types are suitable for use as a PHTM because their write times are not fast enough to store data between the detection of a potential power interruption and the power interruption. For example, disk drives don't typically have fast enough write times for use as a PHTM. In one embodiment, a disk drive 1136 can be used. However, it requires that use of an uninterruptable power supply coupled to the disk drive 1136 and GMC 1160 to maintain power after the external AC power source is lost. Other types of memory with slower write times can be employed when an uninterruptable power supply is used.

Typically, a volatile RAM (random access memory) has a fast enough write speed to be used as a PHTM. However, after the power is lost, data stored in the volatile RAM is lost. To overcome this deficiency, a battery, such as 1124, can be coupled to the RAM 1122 to provide persistence memory storage. This memory configuration can be referred to as a non-volatile RAM (NV-RAM). The battery power levels can be monitored so that it can be replaced as needed. Alternatively or additionally, other forms of nonvolatile memory can be used including for example flash memory, phase change memory, etc.

In one embodiment, an NVRAM 1122 with a battery 1124 is shown inserted in one of the PCI slots 1118. The NVRAM 1122 can be used as a PHTM. In other embodiments, it may be possible to use a RAM inserted into one of the memory slots 1115 that is coupled to a battery. It yet another embodiment, it may be possible to use a high-speed USB connection to a memory storage device to provide a PHTM. As noted above, a hard disk, such as 1136, in combination with an uninterruptable power supply 1148 can be used as a PHTM.

In yet other embodiments, a GMC 1160 may utilize multiple memory storage devices to store crucial data. For example, the NVRAM 1122 can be used as a PHTM. However, crucial data can be copied to a non-PHTM from the NVRAM 1122 as needed. The copied data can provide a back-up of crucial data stored in the PHTM. Further, after crucial data is copied from the PHTM and the validity of the crucial data is verified, it may be deleted from the PHTM to free up space.

In one embodiment, crucial data can be stored in an NVRAM chip and in a high speed read/write compact flash. Crucial data such as RNG outcome, game recall, game state (credits, wager, winnings), and meters can be stored in NVRAM as files. Each file is hashed (MD5 or SHA-1 depending on the file) and the hash answer can be stored with the file.

Additionally, in a particular embodiment, in NVRAM, the critical files can be kept in triplicate with each copy having a separate MD5 hash of the information. Prior to displaying each game outcome, this data can be rehashed and the three outcomes can be compared. If all three hash answers match, the data is deemed to be good and the game results are displayed to the player and a copy is stored in NVRAM. If two of the sets match, the non-matching set is deemed to be corrupt and it is replaced with a copy from one of the other two and the results are displayed to the player. If all three are different, memory can be deemed to be corrupt and a tilt can occur, halting play. The comparisons can occur continuously, each time the memory is updated, which may be multiple times during the course of a single play. However, a comparison can be performed at least once prior to displaying the game outcome.

To protect meters in the event of a power loss, various meters can be stored in NVRAM 1122. Thus, the meters are protected in the event of a power loss. The battery 1124 can be a lithium cell rated, based on the current draw of the NVRAM, to maintain the meters for at least 90 days. In one embodiment, the lithium cell can be rechargeable via the power supply 1146.

In particular embodiments, a game play history associated with recent games can be stored in the NVRAM 1122. This information can be retrieved from the NVRAM 1122 via an operator menu and output to a display, such as display 1018. In particular embodiments, a complete play history for the most recent game played and the nine prior games can be made available. A method involving game play history is described in more detail with respect to FIG. 13.

For a slot game, the game play history can include credits available, credits wagered, number of lines played (when appropriate), bonuses won, progressive won, game winnings (credits won) and credits cashed out. For "pick" bonuses, the intermediate steps involving the player picks can be retained. In games with free spins, the initiating game is retained with all or, for cases where more than fifty free games have been awarded, at least the last fifty free games played. This gaming information can be displayed in the recall screens through standard text meters, screen shots, graphical display elements and textual representations of specific situations that occurred during game play. The game play history can illustrate unique game play features associated with the game in general and specific game features that occurred during the instantiation of a particular play of the wager-based game.

Figure 9:
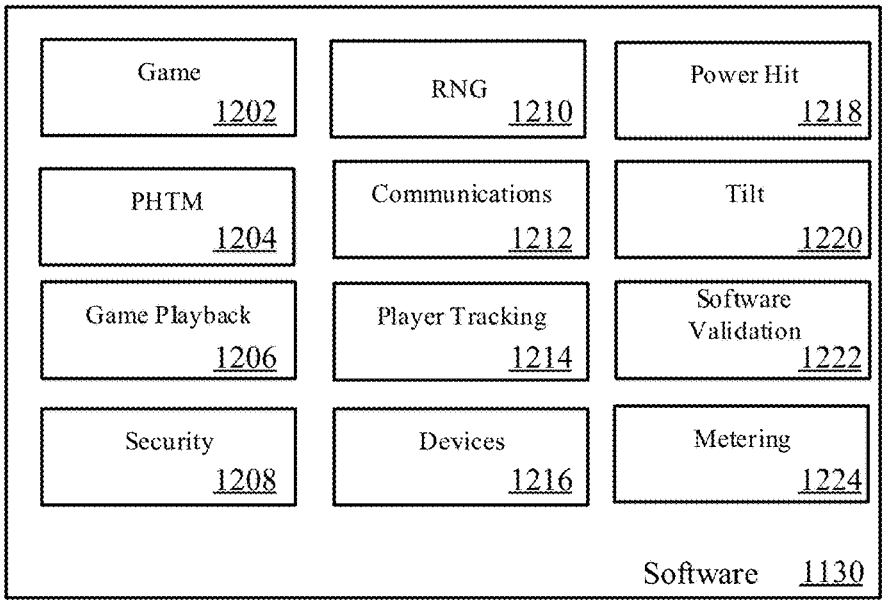
FIG. 9 illustrates a block diagram of gaming software in accordance with the present disclosure.

A gaming machine controller configured to generate a wager-based game in accordance with player selected volatility parameters is described with respect to FIG. 9. Gaming software used to generate the wager-based game is discussed with respect to FIG. 9. With respect to FIG. 11, a power hit tolerant memory configured to store crucial data generated from playing the wager-based game is discussed. The crucial data can include information associated with selected volatility parameters and wager-based games generated using the selected volatility parameters.

Figure 12:
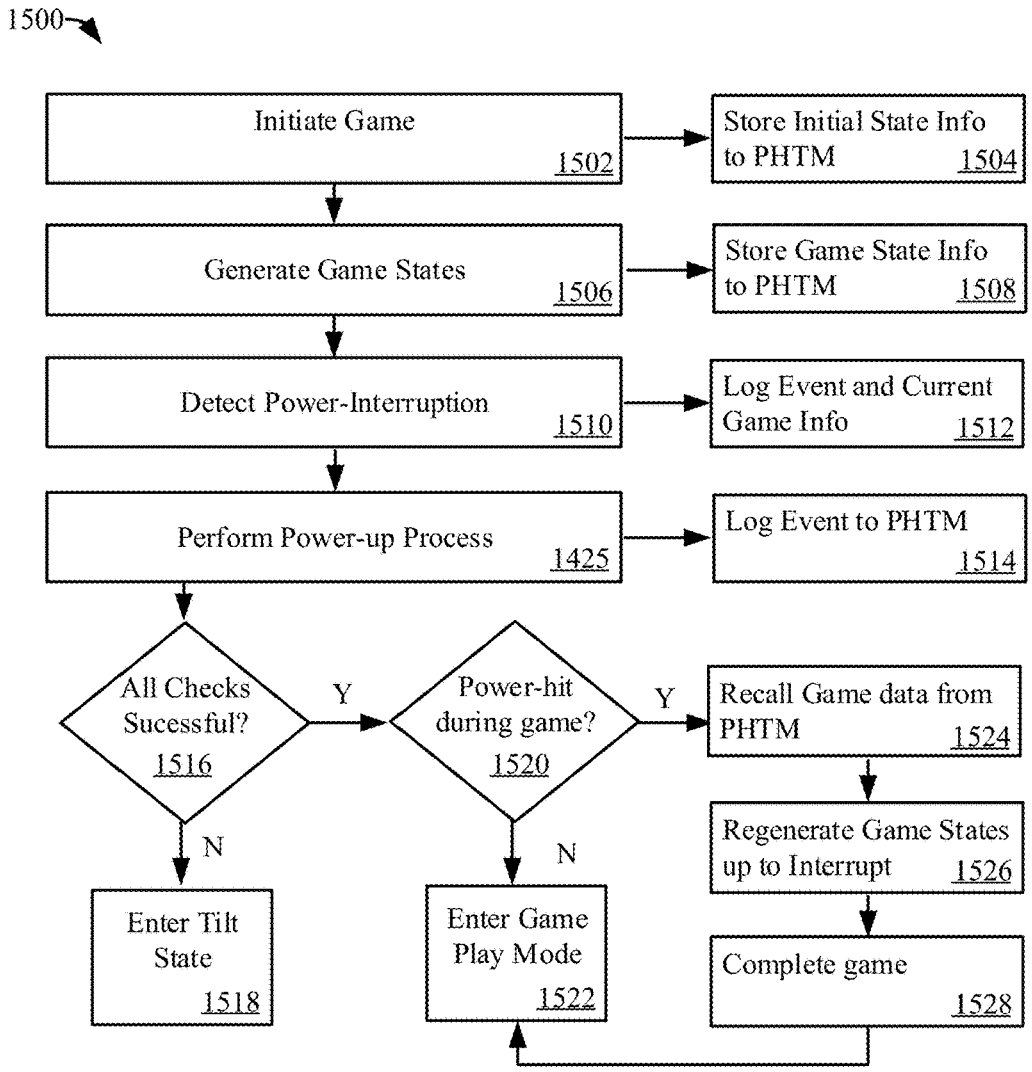
FIG. 12 illustrates a method powering up a gaming machine in accordance with the present disclosure.

With respect to FIG. 12, a method for responding to a power interruption on a gaming machine, which utilizes the power hit tolerant memory, is discussed. With respect to FIG. 13, a method of powering up a gaming machine is described. Finally, with respect to FIG. 14, a method playing back a game, such as a wager-based game including a first primary game and a second primary game, previously played on a gaming machine is discussed.

FIG. 9 illustrates a block diagram of examples of gaming software 1130 that can be executed by a Gaming Machine Controller (GMC) 1160 in FIG. 8. The game software 1202 can be configured to control the play of the game. The play of the game includes determining a game outcome and award associated with the game outcome using the RNG software 1210.

The game software 1202 can be configured to utilize reel strips and/or wheels of chance with different properties. For example, virtual reel strips with different total number of symbols, different symbol combinations and different stopping probabilities. As described above, the game software may utilize different virtual reel strips in response to a selection of different prize structures involving scatter distributed symbols.

The award can be presented as a number of different presentation components where a portion of the award is associated with each presentation component. These presentation components can be referred to as game features. For example, for a video slot game, game features can involve generating a graphical representation of symbols moving, settling into final positions and lining up along a combination of different lines (e.g., paylines). Portion of the award can be associated with different lines. In another example, the game features can involve free spins and chance award of bonus wilds during the free spins. In yet another example, the game feature can involve generating a graphical representation of symbol and then actuating a mechanical device, such as wheel to indicate an award portion.

In a further example, a game feature can involve a bonus game where a portion of an award for a game is presented in a separate bonus game. The bonus game can involve inputting choices, such as a selection of a symbol. Similar to the primary game, the bonus game can include bonus game features where bonus game award is graphically presented in a number of different portions. A primary game can include game features which trigger different bonus games with different bonus game features.

As described above, game features and bonus game features can be stored to a power hit tolerant memory (PHTM). The PHTM software 1204 can be configured to manage the transfer of crucial data to and from the PHTM. Further, as described above, the PHTM software 1204 can be configured to verify the integrity of the data stored in PHTM.

In particular embodiments, the game 1202 has no knowledge of PHTM. Thus, the utilization of the PHTM can be totally abstracted from the game 1202 and contained in a shared object that is loaded at runtime. This shared object will also determine if the PHTM is available and how much memory space is available. If there is no PHTM, or it doesn't contain enough memory, the shared object can be configured to automatically use a disk file instead. This function may allow the game to be run in a windows environment and still have the ability to recover from a power hit.

One purpose of the PHTM 1204 is proper recovery from a power hit. In order to facilitate proper power hit recovery, numerous transition points can be built into the game 1202 where crucial data is stored to PHTM at each transition. The transitions can be implemented as states, which can be referred to as game states or game state machines. The states themselves can also be stored in PHTM so that on startup, after validating that the PHTM is not corrupt, the game 1202 can then check the current state that is stored. That state will then determine where the game will restart. The idea is that whenever a state transition occurs and is saved, the data needed to recover to that state has also been stored in PHTM.

Different approaches can be used in deciding when to save data to PHTM. In one embodiment, a thread runs in the background that constantly checks the data in memory against a copy of what's in PHTM as well as a force write flag. If the force write flag has been set or if it sees that the crucial data has changed, PHTM software 1204 writes it to the physical PHTM, updating the copy as well.

In another embodiment, the PHTM software 1204 can be configured to write all data directly to PHTM as it occurs. At certain times the PHTM software 1204 can be configured queue writes rather than committing them in order to make it an "all or nothing" write. This feature can be normally done for something that is going to cause a state change, a cash-out, etc. This feature can allow all the meters or crucial data associated with the game to be written at once, keeping the window of opportunity for corruption to the smallest amount of time possible.

In particular embodiments, multiple state machines can be used that are based on the overall game state machine. For example, separate "sub-state machines" can be used for critical functions that use external I/O devices, such as bill acceptors and printers. If the game 1202 restarts in a state that requires more granularity and has a different state machine such as a cash out or a ticket inserted state, it can switch to that sub-state machine to complete the actions and then return to the overall game state machine.

In particular embodiments, the sub-state machine concept can be used for areas of the game that are outside of the main game flow such as bonus games. For example, if the game is in a bonus game with bonus game feature including a free spin bonus round and the power cycles before all of the free spins have finished, the game will recover to the spin that was being executed when the power cycled and will continue from there. If the game is in a bonus game during a bonus game feature including a pick bonus, the game 1202 can recover to the point where the power cycle occurred. In particular, the picks that have already been made can be displayed and then the bonus game can continue from that point including receiving additional picks. Further, the game 1202 may be configured using the crucial data stored in the PHTM to regenerate on the display all or a portion of the game states prior to the power hit, such as the initial state of the game and game states that occurred prior to the bonus game.

The game playback 1206 can be used to display information associated with one or more game states of a wager-based game previously played on a gaming machine. As an example, a particular wager-based game can be initiated and played on the gaming machine. During game play of the particular game, crucial data associated with game states that occur can be stored to the PHTM. Subsequently, one or more additional games can be played on the gaming machine. Then, using crucial data recalled from the PHTM, game information associated with the particular game can be redisplayed on the gaming machine. The game information can include but is not limited to a) text information, b) screen shots that were generated during game play and c) a regeneration of all or a portion of a graphical game presentation associated with the particular game.

Typically, to access the gameplay back feature, the gaming machine has to be placed in a tilt mode where an operator menu is available. From the operator menu, using game playback software 1206, an operator can select a particular game for playback from among a plurality of games previously played on the gaming machine. To resume normal game play, the tilt mode can be cleared and the gaming machine can revert to a normal operating state. More details of game play back are described with respect to FIG. 13.

The security software 1208 can be configured to respond to information received from various security sensors disposed on the gaming machine and from the power-off security device (e.g., see 1138 in FIG. 8). For example, the security software 1208 can be configured to detect that a locking mechanism has been actuated on the gaming machine and then cause the gaming machine to enter a tilt mode. As another example, the security software 1208 can be configured to receive information from the power-off security device that the gaming machine door was opened while the gaming machine was being shipped. In response, the security software 1208 can cause the gaming machine to enter a tilt state. In yet another embodiment, the security software 1208 may not be able to detect a sensor, such as a sensor (e.g., see sensors 1140 in FIG. 8) which monitors a state of a door and in response enter a tilt state.

The RNG software 1210 can be configured to generate random numbers used to determine the outcome to a wager-based game. In one embodiment, a Mersenne twister random number generator (RNG) algorithm, which generates integers in the range [0, 2^k−1] for k-bit word length with a period of (2^19937)−1 can be used. It has a longer period and a higher order of equi-distribution than other pseudo-random number generators. The Mersenne Twister is also very fast computationally as it uses no division or multiplication operations in its generation process. It can work well with cache memory and pipeline processing.

In particular embodiments, the RNG cycles at seventy RNG cycles/second or above, such as equal to or above one hundred RNG cycles/second. This speed has been determined by engineers at the Nevada Gaming Control Board to be fast enough that it cannot be timed by the player. The tests showed that above seventy RNG cycles/second successfully hitting a specific outcome became sporadic, and the results were completely unpredictable at one hundred RNG cycles/second. An evaluation showed the variance in the contact mechanism of mechanical switches and the inherent variance in the "button press" detection circuitry, combined with the inability of a person to repeat a movement, provided enough ambiguity in the final registration of the button press to eliminate a player's ability to affect the payback characteristics of the game.

The RNG can be seeded using a plurality of variables. In particular embodiments, the RNG can be seeded by four variables that eliminate the same seed sequence from being used in more than one device, such as two gaming machines using the same RNG seed. The variables can be 1) absolute time, 2) time since the machine powered up, 3) machine number and 4) a random number from the kernel base RNG "/dev/urandom." The random number from the kernel can be associated with the Linux Kernel. This RNG "/dev/urandom" can be based on random occurrences, such as times between keystrokes, mouse movements, timing between interrupts, and hardware occurrences. These occurrences can be used to build and maintain an entropy pool.

The system protects against the same sequence in several ways. First, even if two games are powered on at exactly the same time, there is enough variability in the exact time that the time since power up should prevent any two games from having the same number returned from this function. Also, the "urandom" RNG is entropy based, and is self-seeded from environmental noise contained in the kernel, which makes it unlikely that two machines would ever have the same seed. Finally, the machine number (EPS number) is used as part of the seed. Because this number is used to uniquely identify the gaming machine on the floor, it should always be different from any other machine.

The communications software 1212 can be used to provide communications via the various communication interfaces and using various communication protocols. For example, the communications software 1212 can support the SAS protocol over wired or wireless communication interfaces. In another example, the communication software may allow the gaming machine to communicate with a mobile device via a wireless communication interface using a Bluetooth™ protocol.

The player tracking software 1214 may allow the GMC to communicate with a player tracking device installed on the gaming machine and/or directly with a remote server which provides player tracking services. For example, a player tracking device can be configured to communicate a GMC to transfer credits to and from the gaming machine. In another embodiment, the GMC can be configured to receive player tracking information from a card inserted in a card reader (e.g., see 1028 in FIG. 1) or via wireless communications with a player's mobile device. Then, GMC can communicate with a remote server to receive information associated with a player and send information associated with the player's game play on the gaming machine.

The devices software 1216 may be used to allow the GMC to communicate with various devices coupled to the gaming machine, such as I/O devices coupled to gaming machine. For example, the devices software may allow the GMC to communicate with a bill acceptor (e.g., see bill acceptor 1024 in FIG. 1) and in response add credits to the gaming machine. In another example, devices software may allow the GMC to communicate with a printer (e.g., see printer 1022 in FIG. 1) and in response cash out credits from the gaming machine in the form of printed ticket.

The power hit software 1218 can allow GMC to respond to power hits. For example, the power hit software can monitor the power supply and in response to a detection of power fluctuations update the PHTM with crucial data. In another example, when the gaming machine is power-up from a power hit, the power hit software 1218 can determine the power hit occurred during game play and initiate a restoration of the gaming machine to its state when the power hit occurred.

The tilt software 1220 can be configured to monitor sensors and gaming devices for tilt conditions. In response to the detection of a tilt condition, the tilt software 1220 can cause the gaming machine to enter a tilt state. Further, the tilt software 1220 can record tilt information to the PHTM.

For example, when a machine door open is detected, the game can tilt with a hard tilt that prevents play and disables the game. If the gaming machine includes a tower light, the tower light can flash to indicate that a door is open. Further, a "DOOR OPEN" indication can be displayed on the main display screen. Upon a detection of the door closing, the tower light can stop flashing and the "DOOR OPEN TILT" can be replaced with a "DOOR CLOSED SOFT TILT."

The door open tilt condition can be the behavior for all the machine doors, such as door 1014 in FIG. 1 or a CPU enclosure door (not shown). Additionally, the behavior may not change for multiple doors that are open. Thus, the "DOOR OPEN" indication can remain on, and the machine will be disabled until all the doors are closed. After the final door is closed, the tower light can go off, the game can become playable and the "DOOR OPEN" indication can be written over by a "DOOR CLOSED" indication which will remain until the end of the next game cycle.

A number of tilts can be generated that must be cleared by an attendant. These tilts may include clearing the condition with a key switch or, for tilts such as "PAPER OUT," the tilt may clear automatically after the attendant has remedied the malfunction. A low battery for a PHTM (e.g., see NVRAM 1122 in FIG. 8 or 1204 in FIG. 9) can be indicated by a "RAM BATTERY" tilt.

A "PRINT FAILURE" tilt can occur when there is a failure to print a ticket. In response, a printer hard tilt error can be issued and the description will indicate that the printer is offline. The tilt can be cleared when the printer is brought back online.

A "PRINT MECHANISM/PAPER JAM" tilt can occur for a paper jam. The game can indicate the paper jam has occurred and the printer is off-line (e.g., see printer 1022 in FIG. 1). This tilt can be cleared by clearing the jam and reinserting the paper into the printer.

A "PAPER OUT" tilt can occur when the printer runs out of tickets (e.g., see printer 1022 in FIG. 1). In response to detecting no remaining tickets, the game can display information indicating no paper is available and the game can be disabled. This tilt can be cleared when new printer stock is fed into the printer.

A defective storage media tilt can occur when an error is detected in a critical memory device, such as the memory storing the game software (e.g., see 1130 in FIG. 8), the memory storing the BIOS (e.g., see BIOS 1126 in FIG. 8) or the PHTM storing crucial data (e.g., see NVRAM 1122 in FIG. 8). A message indicating the validation error can be displayed. This tilt may require a "RAM CLEAR" to remedy the tilt condition. A "RAM CLEAR" can erase all meter, recall and other critical memory.

As described above, multiple copies of crucial data can be stored in the PHTM (e.g., see NVRAM 1122 in FIG. 8) and the GMC (e.g., see GMC 1160 in FIG. 8) can be configured to detect and correct copies of faulty data. When uncorrectable memory is detected in the PHTM or another device, it can result in a "CRITICAL MEMORY ERROR" tilt. Again, this tilt can require a "RAM CLEAR" to remedy the condition. Again, the "RAM CLEAR" can erase all meter, recall and other critical memory.

A "BILL JAM" can occur when the bill acceptor detects a bill jam (e.g., see bill acceptor 1024 in FIG. 1). The tilt condition can be displayed on the display, such as main display 1018 in FIG. 1. This is a hard tilt which disables the game until an operator clears the bill jam condition.

When a stacker is full, the game can displays a soft tilt error on the main screen. A "stacker full" may be displayed as a security measure. The stacker can be coupled to a bill acceptor and located in the main cabinet of a gaming machine (e.g., see bill acceptor 1024 in FIG. 1). The game can remain playable but will not accept any further currency or tickets. This tilt is automatically cleared once the stacker is emptied or replaced. When the stacker is removed, the game will be disabled and display a "STACKER OPEN" message. This tilt can be cleared when the stacker is reinserted.

The software validation software 1222 can be executed by the CPU to validate the various software components on the gaming machine. For example, hashes of memory blocks can be performed and compared to stored hash values. This software can differ from the validation logic which is executed separately by the BIOS to perform validation functions.

The metering software 1224 can be used to update the hard meters and generate and update the soft meters. The metering software 1224 can be configured to store metering information to the PHTM (e.g., see NVRAM 1122 in FIG. 8). Examples of the meters which can be maintained are described above with respect to meters 1144 in FIG. 8.

Figure 10:
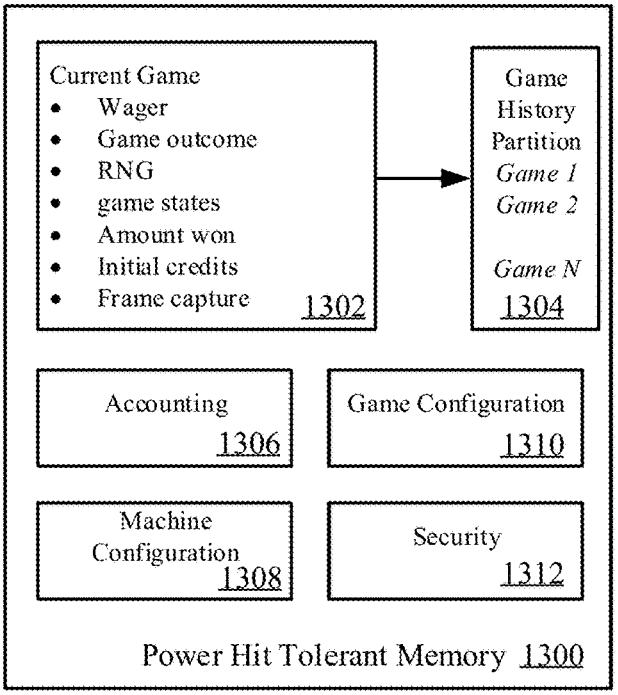
FIG. 10 illustrates a block diagram of power hit tolerant memory in accordance with the present disclosure.

FIG. 10 illustrates a block diagram of one embodiment of a power hit tolerant memory (PHTM) (Additional details of PHTMs are described with respect to NVRAM 1122 in FIG. 8 and PHTM 1204 in FIG. 9). Crucial information associated with the current game can be stored in 1302. Some examples of crucial information include but are not limited to a wager amount, a game outcome, one or more random numbers to determine the game outcome, information about game states and sub-states including the current game state, an amount won, initial credits and frame captures associated with one or more states. As described above, this information can be used to return the game to a current state after a power-hit. The one or more random numbers can be used to regenerate a particular game outcome associated with the random numbers and the wager amount.

After a game is completed, it can be moved to a game history partition 1304. The game history partition can store crucial data associated with a plurality of previously played games. For example, in one embodiment, the PHTM 1300 can be configured to store crucial data associated with the current game and nine past games. In another embodiment, the PHTM 1300 can store information associated with up to one hundred past games.

When the maximum number of games in the game history partition is reached, the software which manages the PHTM 1300 can be configured to delete the oldest game. This process can occur prior to starting the next game. For example, if a maximum of ten games are stored in the game history 1304, then prior to the play of the eleventh game, the oldest game can be cleared from the memory. In one embodiment, prior to the deletion of the crucial data associated with the oldest game, it can be copied to a secondary persistent memory.

In 1306, accounting information can be stored. The accounting information can include the metering information previously described above. In some embodiments, this information can be recalled in the event of a power failure.

In 1308, machine configuration information can be stored. Some example of machine configuration information can include but is not limited to Manufacturer ID, date of manufacturing, machine ID, operating system version, number of screens, cabinet type, hard disk capacity, PHTM capacity, number of PHTM banks, printer model information, touch screen model information, card reader model information, bill acceptor model information, display model information, jurisdiction information, casino name and other information, sales order #, manufacture information, logo's, etc. In one embodiment, the public key used in the code validation process can be stored here.

In game configuration 1310, game configuration information can be stored. The game configuration information can include paytable selection, game features selections, bonus selections, jackpot contribution setting, denominations, max number of paylines, number of game titles and game versions. A gaming machine can have many paytables with different holding percentages which can be selected by the casino. Similarly, selectable game features and bonus features can be provided.

In security 1312, security information can be stored. Security information can include information that lead to a tilt condition and the associated tilt condition. For example, if a door is opened, the security information can include when the door was opened, when game play was disabled, when the door was closed, when the tilt condition was cleared and when game play was subsequently enabled.

Figure 11:
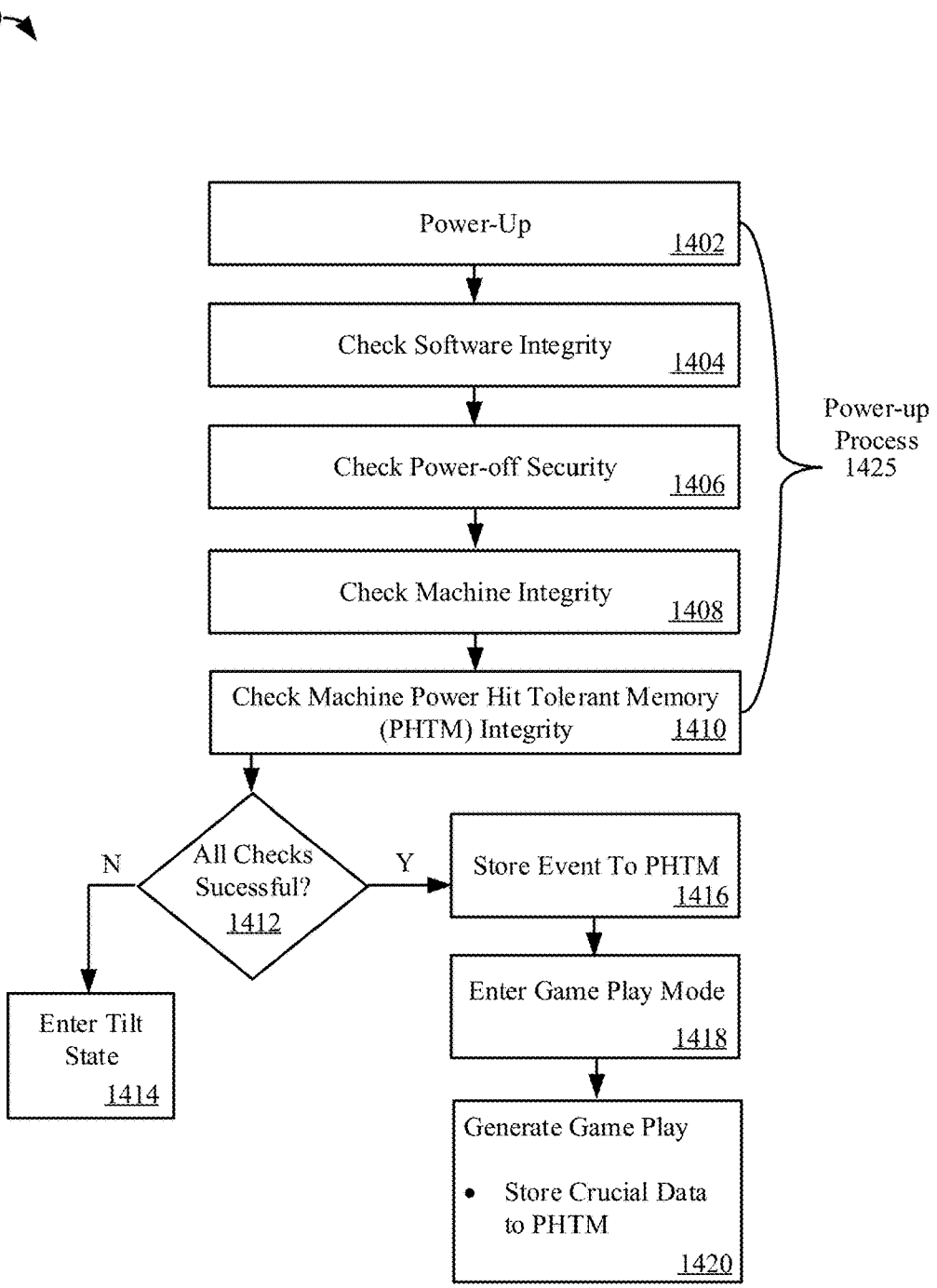
FIG. 11 illustrates a method for responding to a power interruption on a gaming machine in accordance with the present disclosure.

FIG. 11 illustrates a machine-implemented automated method 1400 for responding to a power interruption on a gaming machine. In 1402, the gaming machine can begin a power-up process 1425. The power-up process can begin when a power switch in the interior of the gaming machine is turned on or when power is restored after a power interruption. In response to detecting external power is available, a signal can be generated which initiates a software integrity check on in 1404.

In 1404, the software integrity on the gaming machine can be checked. In particular embodiments, a public key/private key method and a "ladder of trust" can be used to verify control programs executed by the game controller. The initial rung of the ladder of trust can be the BIOS EPROM (see 1126 in FIG. 8), which may be a conventional ROM device. This conventional ROM device can load and can verify the initial code which continues the "verify then load" ladder of trust until the entire operating system and the game is loaded. This process was described above in detail with respect to FIG. 8.

In 1406, the power-off security device (see 1138 in FIG. 8) can be checked. The power-off security can monitor all the doors in the EGM. For example, the doors can use optical emitter/sensor pairs, but some might also use Hall-effect sensors. The system can be a standalone device with a CPU, RAM, NVRAM, sensors I/O board, and battery. The battery can be configured to last at least 30 days. It can be configured to record all critical events, such as power brown out, power black-out, main door open, logic (CPU) door open, bill acceptor door open, printer door open, top box door open and player tracking door open. These critical events may have occurred while the GMC was shut down and hence not monitoring the gaming machine for critical events.

In 1408, the machine integrity can be checked. For example, the security sensors on the gaming machine can be checked to verify all the doors are closed. Further, gaming devices, such as the printer and the bill acceptor, can be checked to determine the devices are operating properly (e.g., see printer 1022 and bill acceptor 1024 in FIG. 1).

In 1410, critical memory on the gaming machine can be checked. For example, the PHTM can be checked to make sure the stored information matches associated hash values. As described, a hash value can be generated for crucial data stored in the PHTM. The hash values can be stored with the crucial data. When the PHTM integrity is checked, new hash values can be generated and compared to the stored hash values.

In 1412, the GMC can determine whether all the checks were successful. If one or more of the checks are not successful, in 1414, the gaming machine can enter a tilt state and game play on the gaming machine can be disabled. Information about the tilt state can be output to a display, such as the main display on which a gaming presentation for a wager-based game is output.

In 1416, when all the checks are successful, event information associated with the successful power-up process can be stored to the PHTM. For example, the time that the gaming machine was enabled for game play can be stored to the PHTM. In one embodiment, as described above, this information can be used to generate a seed for a random number generator used on the gaming machine.

In 1418, the gaming machine can enter game play mode. Thus, the gaming machine is enabled to accept bills and tickets that are redeemed for credits on the gaming machine. After credits are deposited, the gaming machine can be used to make wagers on the game(s) available for play on the gaming machine.

In 1420, the GMC can generate wager-based game play on the gaming machine and store crucial game play data to the PHTM.

FIG. 12 illustrates a method 1500 powering up a gaming machine. In 1502, a wager can be placed and a game can be initiated. In 1504, initial state information associated with the game can be stored to the PHTM. In 1506, game states associated with the game can be generated. In 1508, crucial data associated with the game states can be stored to the PHTM.

In 1510, a power-interruption can be detected. For example, the GMC can receive a signal from the power supply which indicates a power spike associated with a power shutdown has occurred. In 1512, the event can be logged to the PHTM. In addition, current game state information can be logged to the PHTM prior to the power failure. After power is lost, the GMC may no longer operate unless an uninterruptable power supply is available.

In 1425, the power-up process in FIG. 11 can be performed. In 1514, this event can be logged to the PHTM. In 1516, whether the power-up process is successful can be checked. In 1518, if the check is not successful, the gaming machine can be placed in a tilt state and information about the tilt state can be output.

In 1520, a check can be performed to determine whether the power-hit occurred during the play of a game and prior to completion of the game. This information can be stored in the PHTM. In 1524, when the power-hit occurred during the play of a game, data associated with the game including the current game state can be retrieved from the PHTM. In 1526, the game can be regenerated up to the current game state just prior to the power hit. In some embodiments, the gaming machine can be configured in the current game state without showing any information leading up to the current game state. In other embodiments, one or more game states prior to the current game state can be regenerated and output to the display.

In 1528, the current game can be completed. In 1522, the game can be enabled for game play. In 1520, when the power-hit didn't occur during play of a game, the gaming machine can be powered-up and enabled for game play in 1522.

Figure 13:
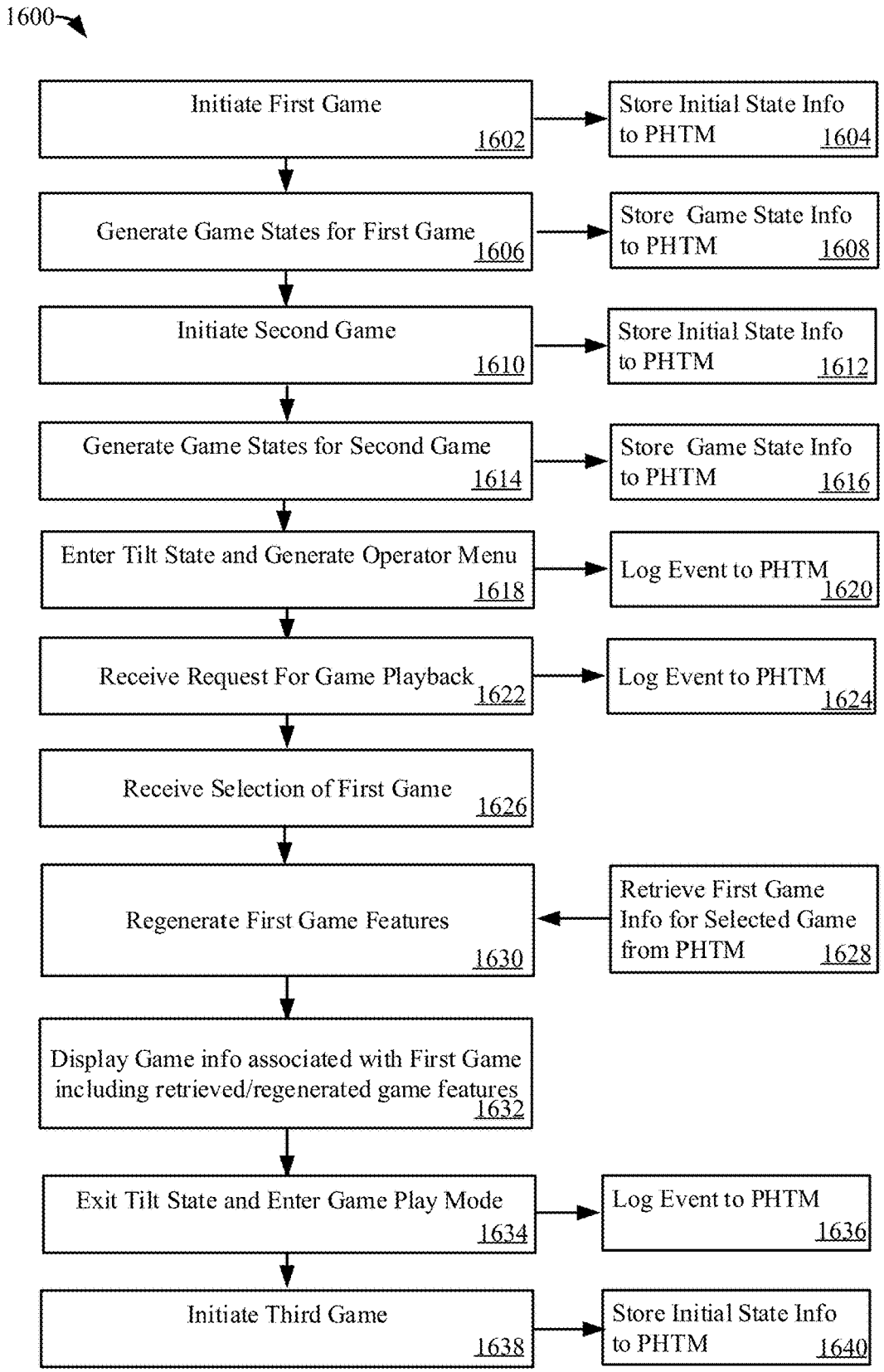
FIG. 13 illustrates a method playing back a game previously played on a gaming machine in accordance with the present disclosure.

FIG. 13 illustrates a method 1600 playing back a game previously played on a gaming machine. In 1602, a first game can be initiated on the gaming machine. In 1604, initial state information about the first game can be stored to the PHTM. In 1606, game states for the first game can be generated. In 1608, the game states can be stored to the PHTM. As described, in the event of a power-hit during play of the first game, the GMC (e.g., see GMC 1160 in FIG. 8) can be configured to restore the game and the gaming machine to a game state just prior to the power hit using information retrieved from the PHTM (e.g., see NVRAM 1122 in FIG. 8).

After the completion of the first game, in 1610, a second game can be initiated. The initial state information for the second game can be stored to the PHTM (e.g., see NVRAM 1122 in FIG. 8). In 1614, the game states for the second game can be generated and the second can be brought to completion. In 1616, the game state information for the second game can be stored to the PHTM.

In 1618, the gaming machine can enter a tilt state. In one embodiment, the tilt state can be initiated in response to the operator inserting and turning a key in a locking mechanism on the outside of the gaming machine cabinet. Then, an operator menu can be generated and output to a display on the gaming machine. In 1620, the tilt state event can be logged in the PHTM.

In the 1622, the gaming machine using an input device, such as a touch screen, can receive a request for a game playback. The game playback can involve displaying information about a game previously played on the gaming machine. In 1624, this event can be logged to the PHTM. In 1626, a particular previously played game can be selected from among a plurality of games with game information stored in the PHTM. In this example, the first game played is selected.

In 1628, game information associated with the first game is retrieved from the PHTM. Some examples of game information which can be retrieved includes but are not limited one or more of random numbers used to generate the first game, screen shots, award information, bet information, credit information and screen shots from one or more game states.

In 1630, first game features can be regenerated. These game features can include animations of the play of the game, which represent one or more game states, or static images representing different game states. The animations of the play of the game can be regenerated using random numbers associated with the original play of the first game.

In 1632, game information associated with the first game, including the retrieved screen shots, regenerated static images and regenerated animations, can be output to a display on the gaming machine. In one embodiment, the display can be the display where the game presentation for the wager-based game is output (e.g., see display 1018 in FIG. 1). In 1634, the gaming machine can exit the tilt state and enter game play mode. For example, to initiate this process an operator can turn a key in the locking mechanism and remove it from the locking mechanism.

In 1636, initiation of game play can be logged as an event to the PHTM. In 1638, a third game on the gaming machine can be initiated. In 1640, the initial state information associated with the third game can be stored to the PHTM.

Because such information and program instructions may be employed to implement the systems/methods described herein, the present disclosure of invention relates to tangible (non-transitory) machine readable media that include program instructions, state information, etc. for performing various operations described herein. Examples of machine-readable media include hard disks, floppy disks, magnetic tape, optical media such as CD-ROM disks and DVDs; magneto-optical media such as optical disks, and hardware devices that are specially configured to store and perform program instructions, such as read-only memory devices (ROM) and programmable read-only memory devices (PROMs). Examples of program instructions include both machine code, such as produced by a compiler, and files containing higher level code that may be executed by the computer using an interpreter.

Although many of the components and processes are described above in the singular for convenience, it will be appreciated by one of skill in the art that multiple components and repeated processes can also be used to practice the techniques of the present disclosure.

While the present disclosure of invention has been particularly shown and described with reference to specific embodiments thereof, it will be understood by those skilled in the art that changes in the form and details of the disclosed embodiments may be made without departing from the spirit or scope of the present teachings. It is therefore intended that the disclosure be interpreted to include all variations and equivalents that fall within the true spirit and scope of the present teachings.

What is claimed is:

1. A gaming machine comprising:

a cabinet including an entry that provides access to an interior of the cabinet, a locking mechanism coupled to the entry and a plurality of security sensors wherein at least one of the plurality of security sensors is used to detect access to the interior of the cabinet;

a power supply, disposed within the interior of the cabinet, receiving power from an external power source;

a power-off security device disposed within the interior of the cabinet, coupled to one or more of the plurality security sensors and monitoring access to the cabinet when the power supply is unpowered;

a display, coupled to the cabinet, outputting content associated with play of one or more wager-based games;

an input source receiving one or more selections from a player;

a non-volatile memory, disposed within a locked box within the interior of the cabinet, storing non-transitory gaming software used to generate the one or more wager-based games on the gaming machine wherein the gaming software defines for display by the gaming machine, a plurality of user-selectable prize structures disposed within a primary game outcome array and available to be wagered upon and a plurality of virtual reel strips wherein predetermined permutations of chance spins of the virtual reel strips are respectively associated with one or more of user-selected ones of the plurality of selectable prize structures for determining if a wager for a given prize structure has been won;

a power-hit tolerant memory, disposed within the locked box within the interior of the cabinet and storing crucial data associated with a play of a plurality instances of the wager-based game;

a gaming machine controller, including a processor and a memory, disposed within a locked box within the interior of the cabinet, coupled to the power supply, the power-off security device, the plurality of security sensors, the display, the non-volatile memory and the power-hit tolerant memory, the gaming machine controller 1) controlling the play of the plurality of instances of the wager-based game, 2) validating the gaming software, 3) verifying integrity of crucial data stored within the power hit tolerant memory, 4) monitoring the power-off security device and the plurality of security sensors to detect tilt conditions; 5) outputting to the display a number of the user-selectable prize structures, 6) during play of a particular instance of wager-based game, receiving a first indication of a selection from the input source of a first set of prize structures from among the number of displayed selectable prize structures; 7) generating an outcome to the particular instance of the wager-based game; 8) storing crucial data associated with the play of the plurality of instances of the wager-based game to the power-hit tolerant memory; 9) determining an instantiation of a series of free spins; 10) displaying a Wilds bonus awarding chance mechanism in response to the determined instantiation of the series of free spins; 11) actuating the Wilds bonus awarding chance mechanism and determining if a predetermined number of bonus Wilds are being awarded; 12) scatter depositing the awarded number of bonus Wilds into the displayed user-selectable prize structures; and 13) incrementing the number of bonus Wilds to be awarded a next time during the series of free spins if the Wilds bonus awarding chance mechanism provides a further win during the series of free spins.

2. A machine-implemented method comprising:

causing, in response to receiving indication of a player submitted wager, an actuation of a first gaming action corresponding to the submitted wager;

after completion of the actuated first gaming action, causing initiation of a first series of free spin gaming actions;

during the first series of free spin gaming actions, causing presentation of a non-zero first count of bonus wilds that will be next inserted upon occurrence of a first chance event into at least a first of the free spin gaming actions of the first series; and during the first series of free spin gaming actions but after said causing of the presentation of the first count, causing presentation of a second count of bonus wilds that will be next inserted upon occurrence of a second chance event into at least a subsequent second of the free spin gaming actions of the first series, the second count being greater than the first count, wherein said bonus wilds are non-sticking wilds which, when awarded, are only effective for the free spin for which they are awarded.

3. The method of claim 2 and further comprising:

during the first series of free spin gaming actions but after said causing of the presentation of the second count, causing presentation of a third count of bonus wilds that will be next inserted upon occurrence of a third chance event into a subsequent at least third of the free spin gaming actions of the first series, the third count being greater than the second count.

4. The method of claim 2 wherein:

the first gaming action includes an apparent spinning of chance reels or wheels whose chance settlement outcome can provide a winning combination of symbols along an active payline of the first gaming action;

the first series of free spin gaming actions includes an apparent spinning of chance reels or wheels whose chance settlement outcome can provide a winning combination of symbols along an active payline of at least one of the free spin gaming actions;

the first count of wilds that will be next inserted upon occurrence of the first chance event are operable to improve a chance of winning of the at least first of the free spin gaming actions if inserted along an active payline of said at least first of the free spin gaming actions; and the second count of wilds that will be next inserted upon occurrence of the second chance event are operable to improve a chance of winning of the at least second of the free spin gaming actions if inserted along an active payline of said at least second of the free spin gaming actions.

5. The method of claim 4 and further comprising:

during the first series of free spin gaming actions, causing a presentation and subsequent actuation of a first chance mechanism having at least one chance outcome that results in insertion into the outcome of the at least first of the free spin gaming actions of said first count of wilds that will be next inserted upon occurrence of the first chance event; and responsive to said first chance mechanism producing the outcome that results in said insertion of the first count of wilds, causing a replacing of the first count with the larger second count.

6. The method of claim 5 and further comprising:

causing presentation of graphics indicating to the player that the first count has been replaced by the larger second count.

7. The method of claim 6 and further comprising:

during the first series of free spin gaming actions but after the first chance mechanism has produced a corresponding result thereof, causing a presentation and subsequent actuation of a second chance mechanism having a respective at least one chance outcome that results in insertion into the outcome of the at least second of the free spin gaming actions of said second count of wilds; and responsive to said second chance mechanism producing the outcome that results in said insertion of the second count of wilds, causing a replacing of the second count with the larger third count.

8. The method of claim 7 and further comprising:

causing presentation of graphics indicating to the player that the second count has been replaced by the larger third count.

9. The method of claim 5 wherein:

said causing of the presentation of the first chance mechanism includes causing the first chance mechanism to be presented in an upper display area of a gaming machine having a lower display area disposed below the upper display area; and outcomes of the free spin gaming actions are caused to be presented in the lower display area.

10. The method of claim 9 wherein:

responsive to the actuated first chance mechanism producing an outcome that results in insertion of said first count of wilds into the outcome of the at least first of the free spin gaming actions, causing a graphic presentation of the first count of wilds parading from the upper display area to the lower display area.

11. The method of claim 9 wherein:

responsive to the actuated first chance mechanism producing an outcome that results in insertion of said first count of wilds into the outcome of the at least first of the free spin gaming actions, causing a scatter distribution of the first count of wilds among plural paylines of the outcome of the at least first of the free spin gaming actions.

12. The method of claim 9 and further comprising:

causing presentation of graphics indicating to the player that the first count has been replaced by the larger second count;

wherein said graphics indicating that the first count has been replaced by the larger second count is caused to be presented in the upper display area of a gaming machine.

13. The method of claim 12 wherein:

said graphics indicating that the first count has been replaced by the larger second count includes a counter showing the larger second count that has replaced the first count as being the next number of wilds that will be next inserted upon occurrence of the second chance event and showing at least one of the first count and a third count that is larger than the second count and which can become a next number of wilds that will be next inserted upon occurrence of a corresponding chance event.

14. The method of claim 12 wherein:

said graphics indicating that the first count has been replaced by the larger second count includes a second chance mechanism showing the larger second count that has replaced the first count as being a possible next number of wilds that will be next inserted upon occurrence of a corresponding chance event and showing other, values smaller than the second count as being possible next numbers of wilds that will be next inserted upon occurrence of corresponding other chance events.

15. The method of claim 9 wherein:

said causing of one or more presentations on at least one of the upper and lower displays of the gaming machine is controlled by one or more servers external of, and operatively securely coupled to the gaming machine.

16. A machine system comprising:

a first machine component receiving indication of a player submitted wager and responsively causing actuation of a first gaming action corresponding to the submitted wager;

a second machine component, coupled to the first machine component and detecting completion of the actuated first gaming action and, after completion of the actuated first gaming action, causing initiation of a first series of free spin gaming actions;

a third machine component, coupled to the second machine component and detecting initiation of the first series of free spin gaming actions and during the first series of free spin gaming actions, causing presentation of a non-zero first count of bonus wilds that will be next inserted upon occurrence of a first chance event into at least a first of the free spin gaming actions of the first series; and a fourth machine component, coupled to the third machine component and detecting continuation of the first series of free spin gaming actions and during the continuation of the first series of free spin gaming actions but after said causing of the presentation of the first count, causing presentation of a second count of bonus wilds that will be next inserted upon occurrence of a subsequent and corresponding second chance event into at least a second of the free spin gaming actions of the first series, the second count being greater than the first count and wherein said bonus wilds are non-sticking wilds which, when awarded, are only effective for the free spin for which they are awarded.

17. The machine system of claim 16 wherein:

the fourth machine component, during the continuation of the first series of free spin gaming actions but after said causing of the presentation of the second count, causing presentation of a third count of bonus wilds that will be next inserted upon occurrence of a corresponding third chance event into at least a third of the free spin gaming actions of the first series, the third count being greater than the second count.

18. The machine system of claim 16 wherein:

the first gaming action includes an apparent spinning of chance reels or wheels whose chance settlement outcome can provide a winning combination of symbols along an active payline of the first gaming action;

the first series of free spin gaming actions includes an apparent spinning of chance reels or wheels whose chance settlement outcome can provide a winning combination of symbols along an active payline of at least one of the free spin gaming actions;

the first count of wilds that will be next inserted upon occurrence of the first chance event are operable to improve a chance of winning of the at least first of the free spin gaming actions if inserted along an active payline of said at least first of the free spin gaming actions; and the second count of wilds that will be next inserted upon occurrence of the corresponding second chance event are operable to improve a chance of winning of the at least second of the free spin gaming actions if inserted along an active payline of said at least second of the free spin gaming actions.

19. The machine system of claim 18 and further comprising:

a fifth machine component, coupled to the third machine component and detecting a non-completion of one of the first series of free spin gaming actions, and causing before completion of said one of the first series of free spin gaming actions, a presentation and subsequent actuation of a first chance mechanism having at least one chance outcome that results in insertion into the outcome of the said one of the first of the free spin gaming actions of said first count of wilds; and a sixth machine component, coupled to the fifth machine component and detecting the at least one chance outcome that results in insertion and to responsively produce an outcome of the said one of the first series of free spin gaming actions that includes said insertion of the first count of wilds.

20. The machine system of claim 19 and further comprising:

a seventh machine component, coupled to the fifth machine component and detecting the at least one chance outcome that results in insertion and responsively causing presentation of graphics indicating to the player that the first count has been replaced by the larger second count.

21. A non-transitory computer readable storage having machine executable instructions recorded therein which when executed by a corresponding machine system perform a method comprising:

causing, in response to receiving indication of a player submitted wager, an actuation of a first gaming action corresponding to the submitted wager;

after completion of the actuated first gaming action, causing initiation of a first series of free spin gaming actions;

during the first series of free spin gaming actions, causing presentation of a non-zero first count of bonus wilds that will be next inserted upon occurrence of a first chance event into at least a first of the free spin gaming actions of the first series; and during the first series of free spin gaming actions but after said causing of the presentation of the first count, causing presentation of a second count of bonus wilds that will be next inserted upon occurrence of a subsequent second chance event into at least a second of the free spin gaming actions of the first series, the second count being greater than the first count and wherein said bonus wilds are non-sticking wilds which, when awarded, are only effective for the free spin for which they are awarded.

22. The computer readable storage of claim 21 wherein the machine system performed method further comprises:

during the first series of free spin gaming actions but after said causing of the presentation of the second count, causing presentation of a third count of bonus wilds that will be next inserted upon occurrence of a subsequent third chance event into at least a third of the free spin gaming actions of the first series, the third count being greater than the second count.

23. The computer readable storage of claim 21 wherein:

the first gaming action includes an apparent spinning of chance reels or wheels whose chance settlement outcome can provide a winning combination of symbols along an active payline of the first gaming action;

the first series of free spin gaming actions includes an apparent spinning of chance reels or wheels whose chance settlement outcome can provide a winning combination of symbols along an active payline of at least one of the free spin gaming actions;

the first count of wilds that will be next inserted upon occurrence of the first chance event are operable to improve a chance of winning of the at least first of the free spin gaming actions if inserted along an active payline of said at least first of the free spin gaming actions; and the second count of wilds that will be next inserted upon occurrence of the second chance event are operable to improve a chance of winning of the at least second of the free spin gaming actions if inserted along an active payline of said at least second of the free spin gaming actions.

24. The computer readable storage of claim 23 wherein the machine system performed method further comprises:

during the first series of free spin gaming actions, causing a presentation and subsequent actuation of a first chance mechanism having at least one chance outcome that results in insertion into the outcome of the at least first of the free spin gaming actions of said first count of wilds; and responsive to said first chance mechanism producing the outcome that results in said insertion of the first count of wilds, causing a replacing of the first count with the larger second count.

25. The computer readable storage of claim 24 wherein the machine system performed method further comprises:

causing presentation of graphics indicating to the player that the first count has been replaced by the larger second count.

* * * * *